US007380609B2

(12) United States Patent
Page et al.

(10) Patent No.: US 7,380,609 B2
(45) Date of Patent: Jun. 3, 2008

(54) METHOD AND APPARATUS OF SUSPENDING, COMPLETING AND WORKING OVER A WELL

(75) Inventors: Peter Ernest Page, East Perth (AU); Alexander Jeffrey Burns, Willetton (AU); John Edward Niski, Manning (AU)

(73) Assignee: Woodside Energy Limited, Perth WA (AU)

( * ) Notice: Subject to any disclaimer, the term of this patent is extended or adjusted under 35 U.S.C. 154(b) by 454 days.

(21) Appl. No.: 10/678,636

(22) Filed: Oct. 6, 2003

(65) Prior Publication Data

US 2005/0028980 A1 Feb. 10, 2005

(30) Foreign Application Priority Data

Aug. 8, 2003 (AU) ..... 2003904183

(51) Int. Cl.
*E21B 33/12* (2006.01)

(52) U.S. Cl. ..... 166/387; 166/345; 166/191

(58) Field of Classification Search ..... 166/313, 166/387, 386, 250.07, 127, 135, 192, 191, 166/264, 341, 360, 345, 378, 379; 175/58, 175/59; 73/152.54
See application file for complete search history.

(56) References Cited

U.S. PATENT DOCUMENTS 3,256,937 A * 6/1966 Haeber et al. ..... 166/344
4,605,074 A * 8/1986 Barfield ..... 175/4.52
4,907,655 A * 3/1990 Hromas ..... 166/321
4,962,815 A 10/1990 Schultz et al.
5,267,469 A 12/1993 Espinoza
5,287,741 A * 2/1994 Schultz et al. ..... 73/152.51
5,337,601 A * 8/1994 Becker et al. ..... 73/170.07
5,404,946 A * 4/1995 Hess ..... 166/187
5,507,345 A 4/1996 Wehunt, Jr. et al.
5,704,426 A * 1/1998 Rytlewski et al. ..... 166/297
5,803,186 A * 9/1998 Berger et al. ..... 175/50
5,826,662 A 10/1998 Beck et al.
5,850,875 A * 12/1998 McCulloch et al. ..... 166/380
5,979,553 A 11/1999 Brink
6,152,230 A * 11/2000 Edwards et al. ..... 166/337
6,170,578 B1 * 1/2001 Edwards et al. ..... 166/339

(Continued)

FOREIGN PATENT DOCUMENTS

EP 1233145 A2 6/1992

(Continued)

*Primary Examiner*—Jennifer H Gay
*Assistant Examiner*—Nicole Coy
(74) *Attorney, Agent, or Firm*—Edell, Shapiro & Finnan, LLC

(57) ABSTRACT

In the various methods of the present invention, reliance is placed on a first and second barrier 26 and 30 respectively positioned in a well 10 to provide well control during well suspension, completion and/or workover operations. Each of the barriers is below the depth of the lowermost end of a completion string when that string is installed in the well 10. By not placing either barrier higher up in the well-bore, both of the barriers can remain in place during suspension and completion and workover operations, thus obviating the need to use a BOP stack to supplement well control. This results in a considerable saving in drill rig time and thus significantly reduces the cost of constructing a well.

15 Claims, 21 Drawing Sheets

U.S. PATENT DOCUMENTS

| | | | | |
|---|---|---|---|---|
| 6,227,300 | B1 * | 5/2001 | Cunningham et al. | 166/339 |
| 6,227,301 | B1 | 5/2001 | Edwards et al. | |
| 6,318,472 | B1 | 11/2001 | Rogers et al. | |
| 6,609,568 | B2 * | 8/2003 | Krueger et al. | 166/250.07 |
| 6,732,797 | B1 * | 5/2004 | Watters et al. | 166/291 |
| 6,776,230 | B2 * | 8/2004 | Collie et al. | 166/97.1 |
| 7,063,157 | B2 * | 6/2006 | Bartlett | 166/339 |
| 2003/0111228 | A1 * | 6/2003 | Garrett et al. | 166/348 |
| 2003/0196820 | A1 * | 10/2003 | Patel | 166/387 |
| 2004/0079529 | A1 * | 4/2004 | Bartlett | 166/339 |
| 2005/0121198 | A1 | 6/2005 | Andrews | |

FOREIGN PATENT DOCUMENTS

| | | | |
|---|---|---|---|
| GB | 2361725 | A | 4/2000 |
| WO | WO 94/03705 | A1 | 2/1994 |
| WO | WO 97/12112 | A1 | 4/1997 |

* cited by examiner

METHOD AND APPARATUS OF SUSPENDING, COMPLETING AND WORKING OVER A WELL

FIELD OF THE INVENTION

The present invention relates to a method of suspending, completing or working over a well and particularly, though not exclusively to a method of suspending, completing or working over a well whilst maintaining at least two deep-set barriers.

The present invention further relates to a suspended or completed well provided with at least two deep set barriers.

The methods of the present invention relate to any type of well, including sub-sea wells, platform wells and land wells. The present invention relates particularly, though not exclusively to wells used for oil and/or gas production, and gas and/or water injection wells.

BACKGROUND OF THE INVENTION

In order to provide adequate well control and to satisfy the statutory safety requirements of many jurisdictions around the world, most operating companies adopt the principle of ensuring that at least two independently verified barriers are in place at all times during the construction or suspension of wells. The term "barrier" as used throughout this specification refers to a physical measure that is capable of forming a seal so as to prevent an uncontrolled release or flow of fluid from the pressure side of the barrier. Well construction operations include all activities from the time the well is drilled until the well is completed ready for production by installing a production flow control device. The most commonly used production flow control devices are typically referred to as "christmas trees".

During well construction operations when at least two barriers may be installed and verified in the well bore, the well may be referred to as being "suspended". A well cannot be temporarily suspended or permanently abandoned without ensuring that the required at least two independently verified barriers are in place.

From time to time during the life of a producing well, remedial action such as repairs or maintenance are required. Such remedial action operations, including interventions, are referred to throughout this specification as "workover operations". When it is required to perform a workover operation, it is again typically a statutory safety requirement of many jurisdictions around the world, that at least two independently verified barriers be in place at all times.

Frequently, a plurality of wells are constructed to tap into a given oil and/or gas reservoir or formation. Depending on the geology of a given site, as well as scheduling requirements, it is common for one or more of the wells to be temporarily suspended for a period of time. These suspended wells may be re-entered and completed as producing or development wells at a later date. At some sites, each well is sequentially drilled and completed. At other sites, the well construction operations may be "batched". When batching is used, the well construction processes are carried out in discrete steps. For example, a first sequence of steps is conducted on a number of wells, followed by a second sequence of steps being conducted on those wells. The process is repeated until each well has been completed. Batching is used to allow well construction operations to be optimised logistically or for completion operations to be performed using a different, typically smaller, rig or vessel than that used for drilling.

Typically, the first step in the construction of a well involves the drilling of a well-bore. FIG. 1 illustrates an example of a typical sub-sea well 10 that has been drilled but not yet suspended. With reference to FIG. 1, the well 10 is provided with a well-head 11 and a guide base 12. A sub-sea BOP stack 40 as well as its associated marine riser 42 is positioned on the well-head 11 to provide well control during the drilling operation. Subsequently, well control is achieved by placement of at least two independently verified barriers elsewhere.

Drilling continues to extend the well bore and additional casing strings are installed sequentially in the well 10. In the illustrated example of FIG. 1, a first casing string 14 with a nominal size of 30 inches is installed first. A second casing string 16 with a nominal size of 20 inches is run with the well-head 11 and cemented into position. A third casing string 18 having a nominal size of 13⅜ inches is provided within the second casing string 16. A fourth and final casing string 20 having a nominal size of 9⅝ inches is provided within the third casing 18.

For platform wells, the casing strings can extend above the mudline or sea-floor to a rig floor 46 or cellar deck 44 of the platform. The well-head is typically located at an uppermost end of the well bore at the mud line for sub-sea wells, at platform level for platform wells or at ground level for land wells.

After the required number of casing strings has been installed, it is common, but not essential, to install a liner 22 which is a string of pipe which does not extend to the surface. The liner is typically suspended from a liner hanger 24 installed inside the lowermost casing string 20.

During drilling of a well, it is common to maintain a sufficient hydraulic head of fluid in the well-bore to provide an over-balance relative to the expected pressure of the reservoir or formation into which the well is being drilled. When the well is to be suspended, other barriers must be provided.

The requirement for a second barrier to be in place at all times is satisfied during drilling and casing operations by positioning a blow-out preventer (BOP) stack the top of the well. Some of the casing strings, the liner, the liner hanger, the first barrier and the completion string are all run through the bore of the BOP stack. For sub-sea wells not using a surface BOP stack, the down-hole equipment must also be run through the bore of the marine riser associated with the sub-sea BOP stack.

To accommodate the running of the down hole equipment through the BOP stack, the BOP stack typically has a nominal internal bore diameter of 18¾ inches and is thus an extremely large piece of equipment. For sub-sea wells, the time taken to run and/or retrieve the BOP stack depends upon the distance between the water-line and the mudline, and in deep water may take several days. The economic viability of offshore operations directly depends on the time taken to perform the various construction operations. Thus, the running and retrieval of a BOP stack is considered to be one of the costliest operations associated with sub-sea well construction.

Using prior art methods, a first barrier, "B1" is typically set above the reservoir or formation as illustrated in FIG. 2. If the well is to be suspended, a second barrier, "B2", must be established and verified elsewhere in the well-bore before the BOP stack can be removed.

It is a longstanding and well-accepted industry practice to position the second required barrier, B2 towards an uppermost end of the well-bore and typically in the well-head 11 or the uppermost end of the final casing string 20 with reference to FIG. 2. This second barrier, B2 was traditionally in the form of a cement plug. More recently, however, the use of cement plugs has been replaced by the use of mechanical barriers to overcome some of the cleanliness problems associated with removal of the cement plugs. The types of mechanical barriers being used as the second barrier include wireline or drill-pipe retrievable devices such as plugs and packers.

There are several factors that motivate operating companies to place the second barrier towards the top of the well. One of the key drivers is the reduced cost in running and/or retrieving the second barrier when it is placed towards the top of the well-bore. It is also widely accepted that the first and second barrier should be placed as far apart as possible to facilitate independent verification of each barrier. If the first and second barriers are set in close proximity it has been considered prohibitively difficult to independently verify the integrity of the second barrier. The integrity of the first barrier is verified by filling the well-bore with a fluid and pressurising the column of fluid to a given pressure. Due to the compressibility of the fluid or entrapped gas, the pressure typically drops over a short period of time before levelling off. If the barrier is leaking, the pressure does not level off.

This procedure is repeated after the second barrier is installed. When the second barrier is positioned in the uppermost end of the well-bore, the quantity of fluid need to pressurise the well-bore during pressure testing is greatly reduced if the second barrier has integrity. It is thus easy to detect if fluid is passing this upper barrier.

To prepare the well for production, a "completion string" is installed in the well bore. The term "completion string" as used throughout this specification refers to the tubing and equipment that is installed in the well-bore to enable production from a formation. The upper end of the completion string typically terminates in and includes a tubing hanger from which the completion string is suspended. The completion string typically includes an annular production packer positioned towards the lowermost end of the completion string. The packer isolates the annulus of the well-bore from the completion string, the annulus being the space through which fluid can flow between the completion string and the casing string and/or liner. The lowermost end of the completion string is commonly referred to as a "tail pipe".

When the well is ready for production, the oil, water and/or gas passes through the liner or casing and through the completion string to a production flow control device located at or above the well-head.

The well suspension methods of the prior art require removal of the upper barrier before the well can be completed. To provide the required second barrier, the BOP stack must be re-installed above the well in what has been a long-standing, commonly employed industry practice. The BOP stack cannot be removed until at least two barriers are established elsewhere. The requirement to install a BOP stack generates a number of problems. Firstly, the operations that must be performed prior to removal of the BOP stack are limited to tooling which can pass through the internal diameter of the bore of the BOP stack. Secondly, the bore of the BOP stack (and its associated marine riser for sub-sea wells) may contain debris such as swarf, cement and/or cuttings in the rams or annular cavities of the BOP stack, as well as debris in the drill and/or choke lines and/or corrosion product in the marine riser. Consequently, one of the problems with current well construction practice is the high level of debris that accumulates as the completion string and other equipment pass through the bore of the BOP stack and/or its associated marine riser. Thirdly, the need to run or recover the BOP stack during well construction operations can add considerable expense to the cost of these operations with costs being directly proportional to the amount of rig time that must be allocated to these operations.

There is a need for less time-consuming and therefore less expensive method of well construction.

It will be clearly understood that, although prior art use is referred to herein, this reference does not constitute an admission that any of these form a part of the common general knowledge in the art, in Australia or in any other country.

In the summary of the invention and the description and claims which follow, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

SUMMARY OF THE INVENTION

The present invention is based on a breakthrough realisation that the construction operations for wells can be radically simplified by positioning each of the at least two independently verifiable barriers below the anticipated depth of the lowermost end of the completion string. By not placing either barrier higher up in the well-bore, both of the barriers can remain in place during suspension and completion operations, thus obviating the need to use a BOP stack to supplement well control. This results in a considerable saving in drill rig time and thus significantly reduces the cost of constructing a well.

The term "barrier" as used throughout this specification refers to a physical measure that is capable of forming a seal so as to prevent an uncontrolled release or flow of fluid from the pressure side of the barrier. To serve the function of a barrier, the physical measure must be able to hold its position in the well-bore. The device or combination of devices are typically secured in position, typically against an internal wall of one of the casing strings or the liner. The barrier need not be retrievable. A plurality of physical measures may be used in combination to provide the barrier, with one or more of the measures serving as a sealing means and one or more other measures being used to secure the barrier in position.

The term "deep-set barrier" as used throughout this specification refers to a barrier that is located below the depth of the lowermost end of a tubing string (typically hung from a tubing hanger or other equipment) when the tubing string is installed in its final position in the well.

The term "BOP stack" as used in this specification includes surface BOPs, as well as sub-sea BOPs. The BOP stack would typically comprise a combination of pipe and blind rams, annular preservers, kill and choke lines and may include a lowermost connector and an upper and/or lower marine riser.

According to one aspect of the present invention there is provided a method of suspending a well comprising the steps of:

providing a first barrier in the well;

verifying the integrity of the first barrier;

thereafter providing at least a second barrier in the well above the first barrier defining a space between the first and second barriers; and, verifying the integrity of the second barrier, the method characterised in that the first and second barriers are below the depth of a lowermost end of a completion string when the completion string is installed in the well and remain in position while the well is suspended.

Preferably the step of verifying the integrity of the second barrier further comprises the step of measuring the pressure in the space between the first and second barriers.

Preferably the first and/or second barrier(s) is/are selected from the group consisting of: a cement plug; an unperforated liner; a section of unperforated casing; a liner top valve; a bridge plug; a straddle; an expandable plug; a disappearing plug; a rupture disc; or an inflatable plug packer.

The first and/or second barrier(s) may comprise a combination of a physical device, a means for securing the position of the physical device, and a sealing means. Preferably the sealing means is selected from the group consisting of: a ball valve; a flapper valve; a sliding sleeve; a pressure cycle plug; a wireline retrievable plug; a rupture disc; a formation isolation device; a shear disc; and/or a pump open device.

The sealing means may be positioned distally from the physical device or at the same location.

Preferably the method further comprises the step of installing a first and/or second liner hanger in the well. More preferably, the first and/or second barrier is/are provided within the first and/or second liner hanger.

Alternatively or additionally the method further comprises the step of installing a first and/or second liner in the well. More preferably the first and/or second barrier is/are provided within the first and/or second liner.

Preferably the well includes at least one casing string and the first and/or second barriers are provided within the at least one casing string.

According to a second aspect of the present invention there is provided a method of completing a well, comprising the steps of:

providing a first barrier in the well;

verifying the integrity of the first barrier;

thereafter providing at least a second barrier in the well above the first barrier defining a space between the first and second barriers;

verifying the integrity of the second barrier;

relying on the first and second barriers to provide well control during installation of a completion string in the well, the completion string having a lowermost end; and, installing a production flow control device on the well for regulating the flow of fluids through the well, the method characterised in that the first and second barriers are below the depth of the lowermost end of the completion string when the completion string is installed in the well.

Preferably the method further comprises the step of installing a tubing spool in the well-head prior to the step of installing the completion string in the well.

The production flow control device may be a christmas tree.

Preferably the production flow control device is a horizontal christmas tree. More preferably the horizontal christmas tree includes having a body, the completion string terminates at its upper end and is suspended from its tubing hanger, and the method further comprises the step of forming an assembly comprising the horizontal christmas tree and the tubing hanger by landing and locking the tubing hanger in the body of the horizontal christmas tree prior to the step of installing the production flow control device on the well.

Alternatively, the christmas tree is a vertical christmas tree.

According to a third aspect of the present invention there is provided a method of working over a completed well, the completed well including a production flow control device and a completion string installed in the well-bore, the completion string having an uppermost end terminating in a tubing hanger from which the completion string is suspended and a lowermost end, the method comprising the steps of:

providing a first barrier in the well;

verifying the integrity of the first barrier;

thereafter providing at least a second barrier in the well above the first barrier defining a space between the first and second barriers;

verifying the integrity of the second barrier;

relying on the first and second barriers to provide well control during removal of the tubing hanger, completion string, and/or production flow control device from the well; and, the method characterised in that the first and second barriers are below the depth of the lowermost end of the completion string when the completion string is installed in the well.

Preferably the horizontal christmas tree includes a body and the method of working over the well further comprises the step of removing the tubing hanger and/or completion string from the body of the horizontal christmas tree by unlocking the tubing hanger from the body of the horizontal christmas tree.

Alternatively the horizontal christmas tree includes a body and the method of working over the well further comprises the step of removing the horizontal christmas tree and the completion string as an assembly.

Preferably the method of working over the well further comprises the step of relying on the first and second barriers to provide well control until the tubing hanger, completion string and/or production flow control device are reinstalled in or on the well.

According to a fourth aspect of the present invention there is provided a suspended well comprising:

a well bore having an uppermost end;

a well head installed towards the uppermost end of the well-bore; and, at least a first and a second independently verified barrier positioned in a spaced-apart relationship in the well bore defining a space between the first and second barriers, characterised in that the first and second barriers are below the anticipated depth of a lowermost end of a completion string when the completion string is installed in the well.

According to a fifth aspect of the present invention there is provided a completed well comprising:

a well bore having an uppermost end;

a well head installed towards the uppermost end of the well-bore;

a production flow control device on or above the well-head;

a completion string installed in the well-bore and having a lowermost end; and, at least a first and a second independently verified barrier positioned in a spaced-apart relationship in the well bore defining a space between the first and second barriers, characterised in that the first and second barriers are below the lowermost end of the completion string.

Preferably the suspended or completed well further comprises a pressure measuring means for generating a signal indicative of the pressure in the space between the first and second barriers. More preferably the suspended or completed well further comprises a signal receiving means for receiving the signal generated by the pressure measuring means. More preferably still the suspended or completed well further comprises a means for transmitting the signal from the pressure measuring means to the pressure signal receiving means.

Preferably the pressure measuring means is a transducer.

The suspended or completed well may be a sub-sea well, a land well or a platform well.

Preferably the suspended or completed well further comprises a first and/or second liner installed in the well. More preferably the first and/or second barrier are positioned within the first and/or second liner.

Preferably the suspended or completed well includes at least one casing string and the first and/or second barriers are provided within the at least one casing string.

Preferably the completed well further comprises a tubing spool installed in the well-head.

Preferably the production flow control device is a christmas tree. More preferably the production flow control device is a horizontal christmas tree. Alternatively, the production flow control device is a vertical christmas tree.

According to a sixth aspect of the present invention there is provided a dual barrier system for use in suspending, completing or working over a well, the dual barrier system comprising:

- a first and second body barrier positioned in a spaced-apart relationship in the well and defining a space between the first and second barriers;
- a pressure measuring means for generating a signal indicative of the pressure in the space between the first and second barriers;
- a pressure signal receiving means for receiving the signal generated by the pressure measuring means; and,
- a means for transmitting the signal from the pressure measuring means to the pressure signal receiving means.

According to a seventh aspect of the present invention there is provided a method of completing a sub-sea well using a horizontal christmas tree for production flow control, the horizontal christmas tree having a body, the method comprising the steps of:

- forming an assembly by installing a completion string terminating at its upper end in and suspended from a tubing hanger in the body of the horizontal christmas tree; and,
- running the assembly to the sub-sea well, the method characterised in that the tubing hanger and the horizontal christmas tree are above the water-line during the step of forming the assembly.

Preferably the step of forming the assembly further comprises the steps of landing and locking the tubing hanger in the body of the christmas tree. More preferably the method of completing a sub-sea well using a horizontal christmas tree for production flow control further comprises the step of verifying the integrity of the completed assembly above the water line.

Preferably the step of verifying the integrity comprises the step of verifying hydraulic and electrical interfaces between the tubing hanger and the body of the christmas tree. More preferably the step of verifying the integrity further comprises the step of verifying the pressure integrity of the assembly.

Preferably the step of running the assembly to the well head comprises the step of using a lower-riser package.

DESCRIPTION OF THE FIGURES

The preferred embodiments of the present invention will now the described, by way of example only, with reference to the accompanying drawings, in which.

DESCRIPTION OF THE PREFERRED EMBODIMENTS

Before the preferred embodiments of the present methods are described, it is understood that this invention is not limited to the particular sequence or types of barriers described. It is also to be understood that the terminology used herein is for the purpose of describing particular embodiments only, and is not intended to limit the scope of the present invention. Unless defined otherwise, all technical and scientific terms used herein have the same meanings as commonly understood by one of ordinary skill in the art to which this invention belongs.

Although other types of barriers and particular well completion and/or work over sequences similar or equivalent to those described herein can be used to practice or test the various aspects of the present invention, the preferred barriers and methods are now described with reference to suspension, completion and workover of a sub-sea well. It is to be clearly understood that the present invention is equally applicable to land wells, as well as platform wells.

It is to be noted that FIGS. 1 to 20 are not to scale and that the length of various strings of tubing, casing and/or liner will vary depending on the requirements a particular site such as the depth of water above the mudline and the depth and geology of the particular reservoir or formation being drilled. By way of example, for sub-sea wells the mudline may be in the order of 20 to 3000 meters below the water-line with the reservoir or formation being in the order of one to three kilometres below the mudline.

It is also to be noted that the sub-sea christmas tree of the illustrated example of FIGS. 3 to 10 is a monobore type while the sub-sea christmas tree of the illustrated example of FIGS. 11 to 15 and 17 to 20 is a dual bore type. It is to be clearly understood that the various aspects of the present invention are equally applicable to monobore, dual bore and multibore wells.

Figure 1:
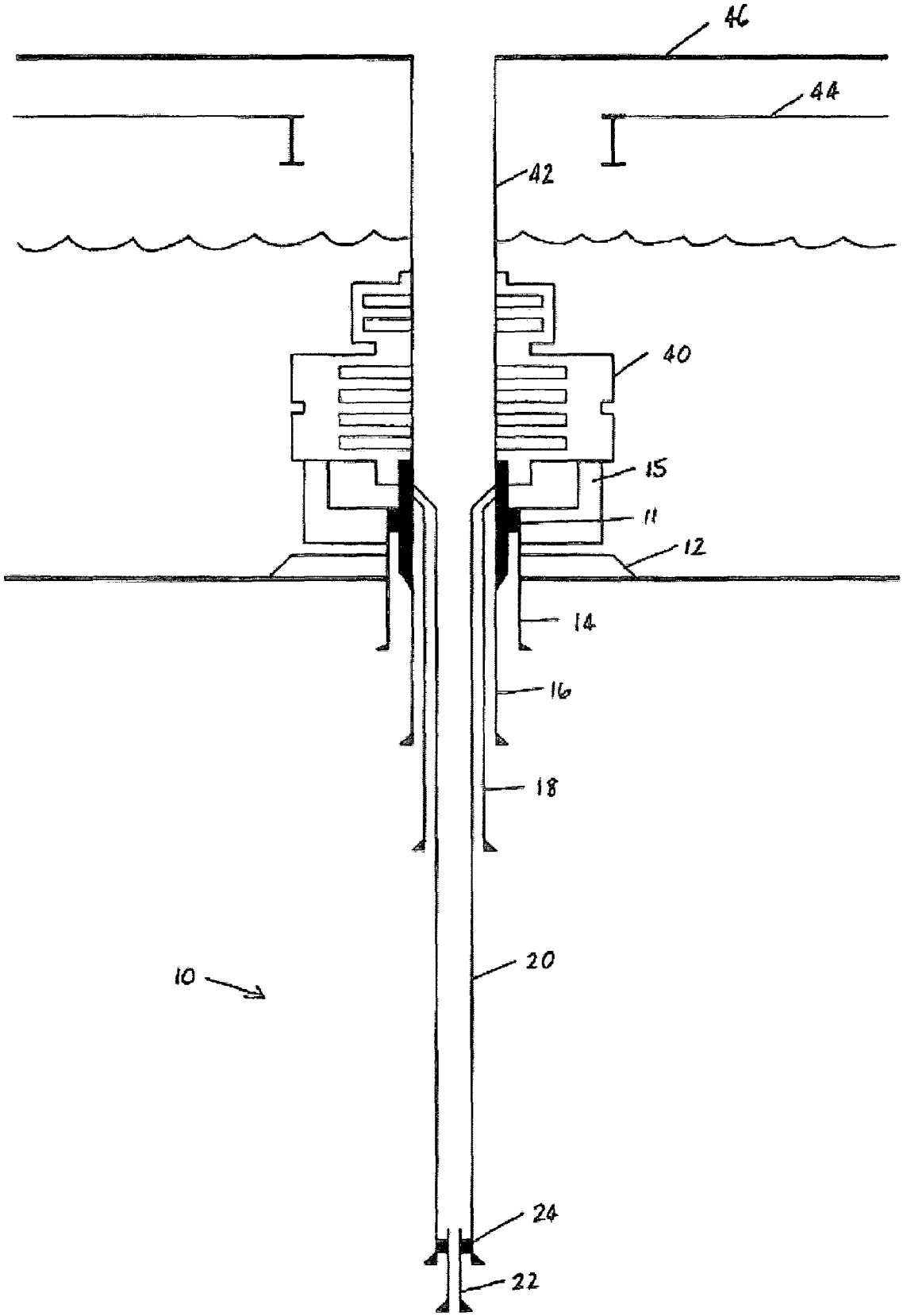
Figure 1 (Prior Art)
FIG. 1 illustrates a typical drilled well prior to being suspended using prior art methods of well suspension.
Figure 2:
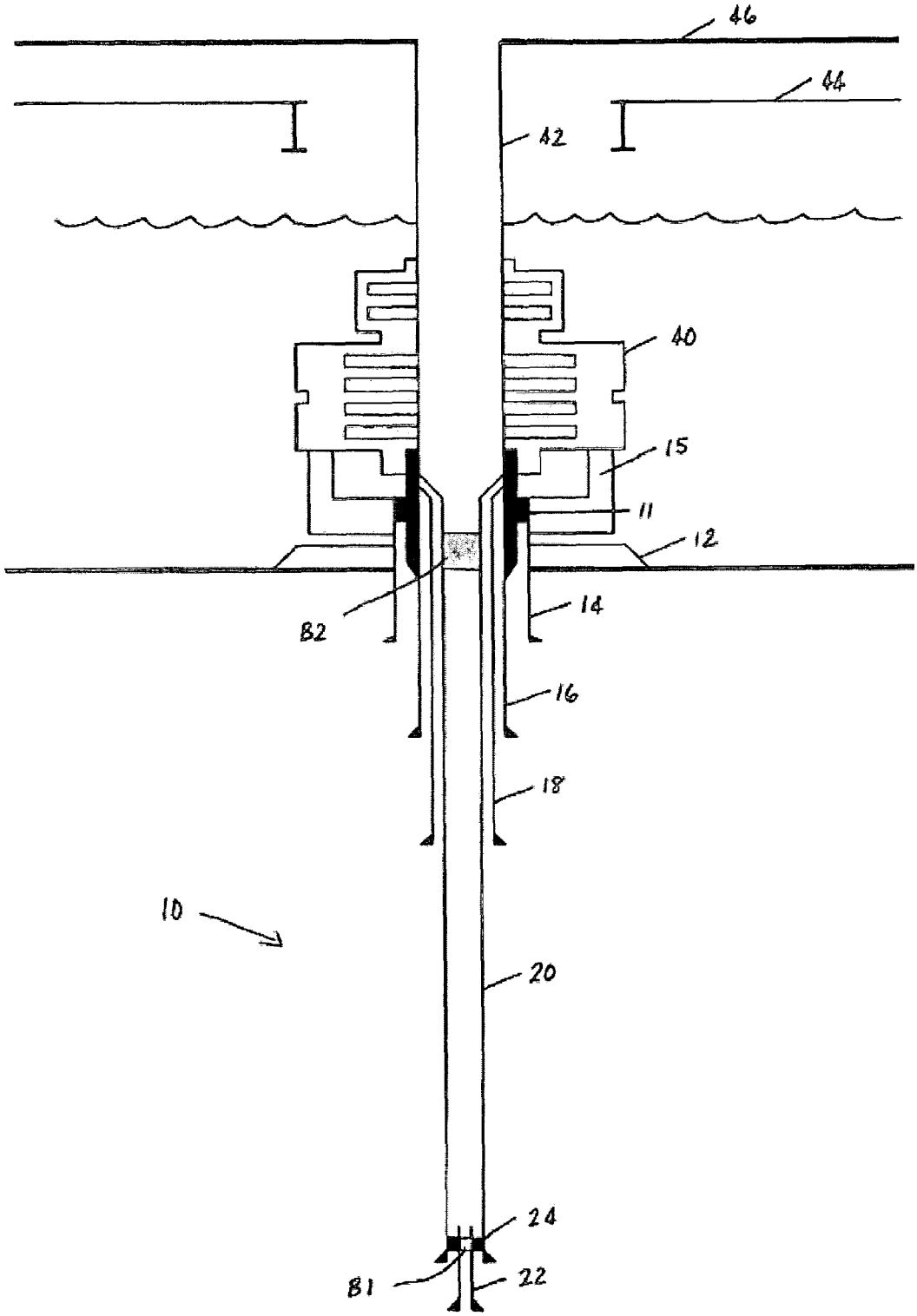
Figure 2 (Prior Art)
FIG. 2 illustrates a suspended well in accordance with a common prior art method of well suspension.
Figure 3:
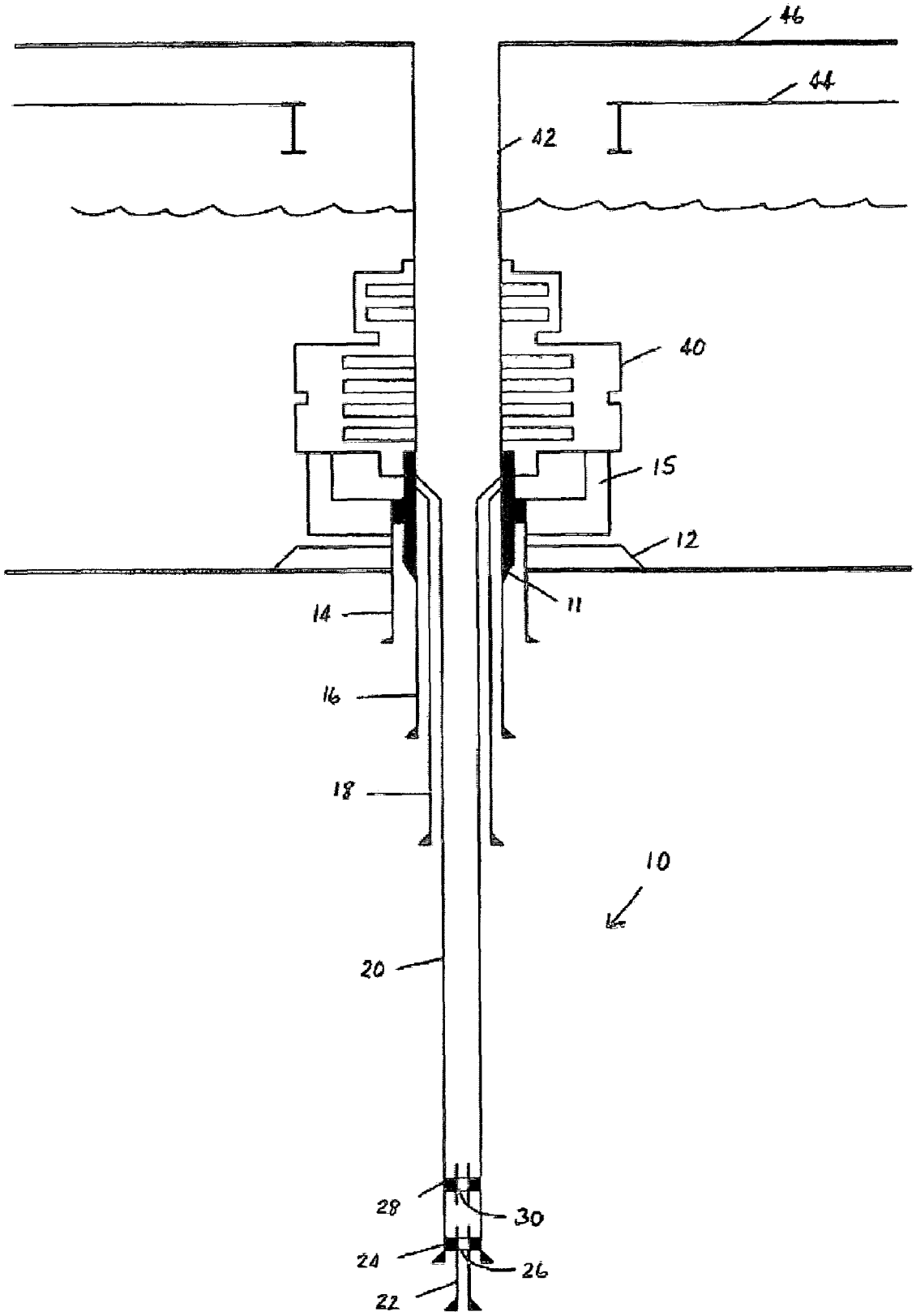
FIG. 3 illustrates a first step in a well completion sequence of a first embodiment of the present invention showing the placement of casing strings and the liner as well as dual deep-set barriers whilst a BOP stack in position.
Figure 4:
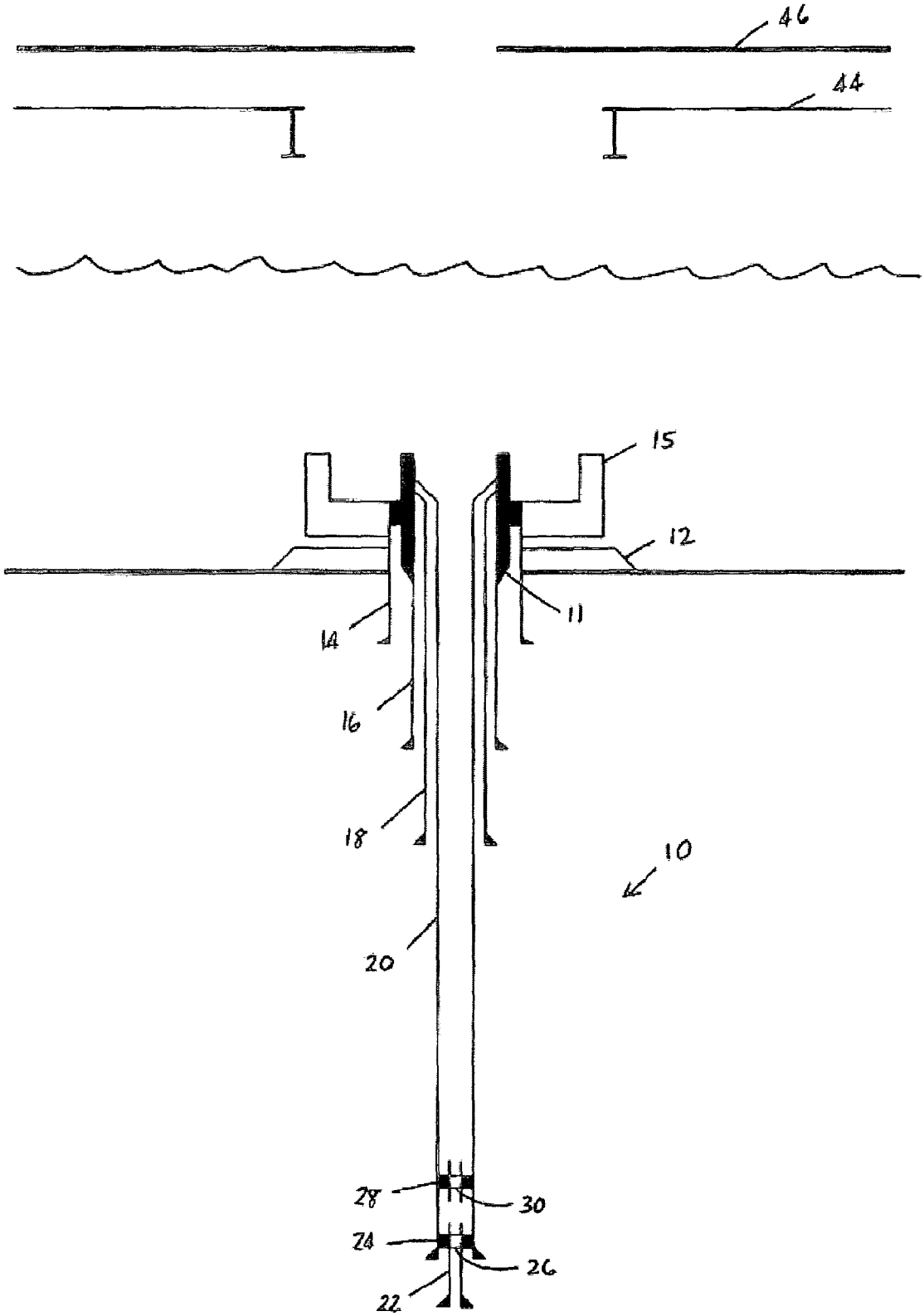
FIG. 4 illustrates a next step in a well completion sequence of a first embodiment of the present invention in showing a well with suspended with dual deep set barriers.

A first preferred embodiment of the method of suspending a well is illustrated in the sequence of FIGS. 3 and 4. With reference to FIG. 3, a sub-sea well 10 has been drilled and provided with a well-head 11 and a guide base 12. A sub-sea BOP stack 40 as well as its associated marine riser 42 is positioned on the well-head 11 for temporary well control. Subsequently, well control will be achieved by placement of at least two independently verified barriers elsewhere.

A required number of casing strings is installed in the well 10. In the illustrated embodiment of FIG. 3, a first casing string 14 with a nominal size of 30 inches is installed first. A second casing string 16 with a nominal size of 20 inches is run with the well-head 11 and cemented into position. A third casing string 18 having a nominal size of 13⅜ inches is provided within the second casing string 16. A fourth and final casing string 20 having a nominal size of 9⅝ inches is provided within the third casing 18.

It is to be understood that while four concentric casing strings are illustrated in FIG. 3, the present invention is equally applicable to sub-sea wells provided with any number of casing strings with other nominal sizes as required.

With reference to FIG. 3, a liner 22 is then installed within the final casing string 22. The liner 22 hangs from a first liner hanger 24. It is to be understood that while a liner 22 and a liner hanger 24 are used in the illustrated embodiment of FIG. 3, the method of suspending a well is equally applicable to wells that do not utilise liners or liner hangers. A first deep-set barrier 26 is installed in the first liner hanger 24 and/or first liner 22. The integrity of the first barrier 26 is then verified. A second liner hanger 28 along with a second liner 23 is then positioned within the final casing string 20 above the first liner hanger 24, defining a space 35 therebetween. A second deep-set barrier 30 is placed within the second liner hanger 28 and/or second liner 23 and the integrity of the second barrier 30 is independently verified.

Figure 5:
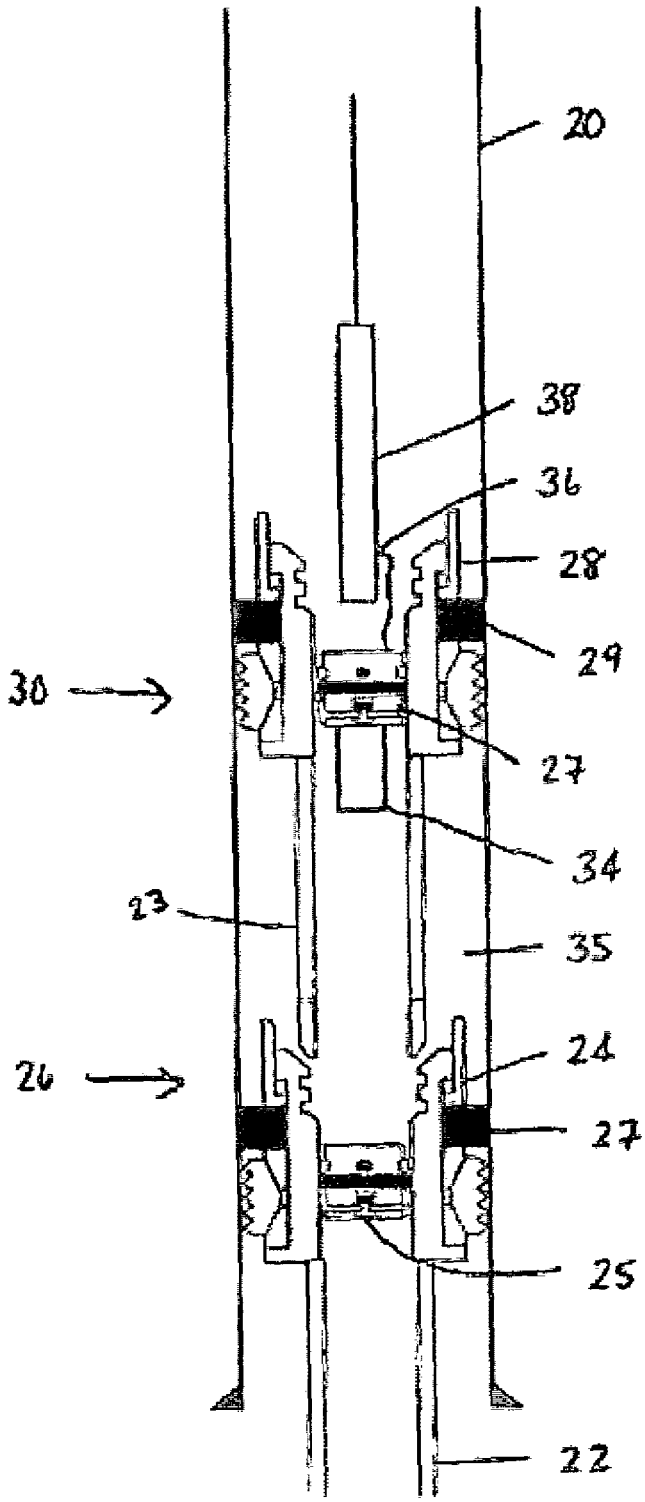
FIG. 5 illustrates one embodiment of a dual barrier system for use in suspending a well.

One preferred embodiment for providing the two independently verified deep-set barriers in the form of a dual barrier system 32 is illustrated in FIG. 5. With reference to FIG. 5, the first barrier 26 is provided by the combination of a physical measure in the form of a first plug 25 and a separate sealing means in the form of a first annular seal 27. The first plug 25 is secured in position in and forms a seal across the bore of the first liner hanger 24 and/or the first liner 22. The first annular seal 27 is provided with the first liner hanger 24 and/or first liner 22 to form a seal between the outer diameter of the first liner hanger 24 and/or first liner 22 and the internal diameter of the final casing string 20.

The integrity of the first barrier 26 is then verified using known techniques.

The second barrier 30 of the dual barrier system 32 as illustrated in FIG. 5 is provided by first installing a second liner hanger 28 along with second liner 23 above the first liner hanger 24 defining a space 35 therebetween.

The second barrier 26 is provided by the combination of a physical measure in the form of a second plug 27, typically a wireline retrievable plug, and a separate sealing means in the form of a second annular seal 29. The second plug 27 is secured in position in and forms a seal across the bore of the second liner hanger 28 and/or second liner 23. The second annular seal 29 is provided with the second liner hanger 28 and/or second liner 23 to form a seal between the outer diameter of the second liner hanger 28 and/or second liner 23 and the internal diameter of the final casing string 20.

The integrity of the second barrier 30 may then be verified. It has been previously considered that barriers relied upon to provide well control during well completion and/or workover operations should not be positioned in close proximity to each other as discussed above. This is because it is considered to be difficult to verify the independence of the second barrier if the space between the two barriers has a relatively small volume.

This problem is overcome in the illustrated embodiment of FIG. 5 by providing a pressure measuring means in the form of a pressure transducer 34 in the space 35 between the first and second barriers. The pressure transducer 34 is capable of generating a signal indicative of the pressure in the space 35. The signal from the pressure transducer 34 is transmitted using any suitable means such as a wireless signal, breakable hard wire link or disconnectable hard wire line to a pressure signal receiving means 36.

In the illustrated embodiment of FIG. 5, the pressure signal receiving means 36 is incorporated in a plug running tool 38 in electrical communication with a means for interpreting the pressure signal (not shown) positioned above the water-line, typically accessed at the rig floor 46 and less preferably at the cellar deck 44.

It is to be understood that the pressure measuring means need not be provided with the second barrier 30, the only proviso being that the pressure measuring means is capable of generating a signal indicative of the pressure in the space between the first and second barriers. The pressure verification means 34 may therefore equally be positioned on an uppermost face of the first barrier, an internal diameter of the liner hanger or an internal diameter of a section of the lowermost casing string.

In use, the signal from the pressure transducer 34 is received and interpreted by the pressure signal receiving means 36 enabling independent verification the integrity of the second barrier 30 after the integrity of the first barrier 26 has been independently verified.

The placement of at least two independently verifiable barriers within the liner hangers in the preferred embodiment represents one way of placing these barriers. Other options for providing the first and second barrier for the dual barrier system as described below with reference to FIG. 21, 22 and 23.

Figure 21:
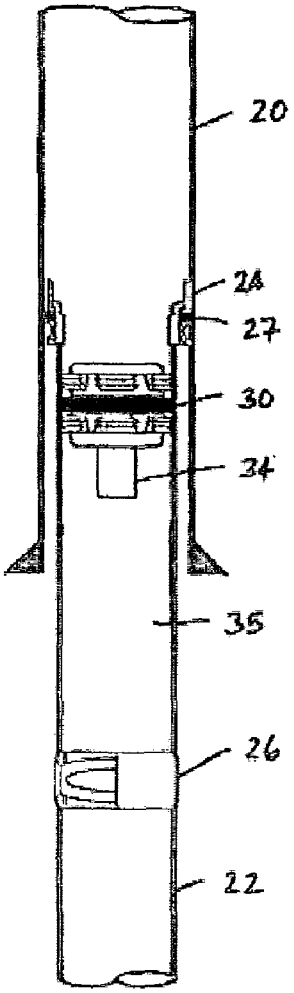

In FIG. 21 the first (lower) barrier 26 is provided by either a liner top-isolation device, a multi-acting reciprocating device, a ball valve or flapper valve which forms a barrier across the full width of the bore of the liner 22. The second (upper) barrier 30 is provided by way of a mechanical device such as a wireline retrievable plug installed in the second liner 23.

Figure 22:
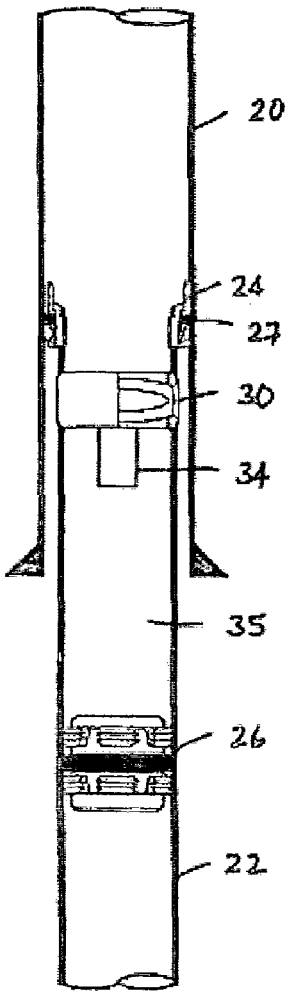

In FIG. 22, the first barrier 26 is provided by way of a full bore wireline retrievable device or cement plug in the first liner 22. The second barrier 30 is provided by way of a liner top-isolation device, a multi-acting reciprocating device, a ball valve or flapper valve installed in the second liner 23.

Figure 23:
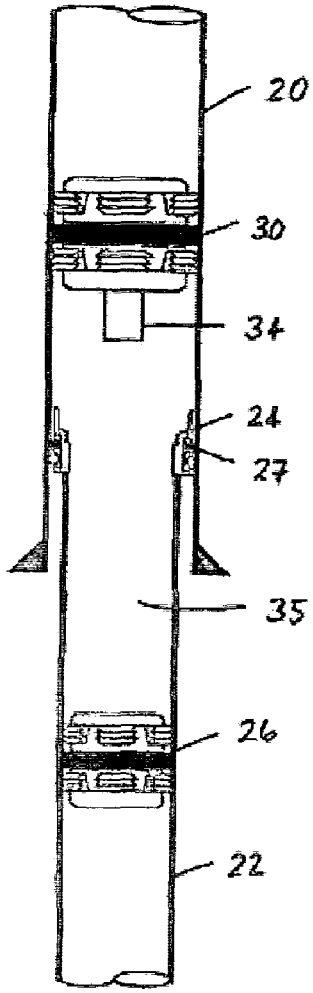

In FIG. 23, the first barrier 26 is provided by way of a full-bore wireline retrievable or cement plug in the first liner 22. The second barrier 30 is provided by way of a wireline retrievable or cement plug installed to seal across the full bore of the final casing string 20.

The first and/or second barrier may thus equally be selected from the group consisting of: a cement plug; an unperforated liner; a section of unperforated casing; a liner top valve; a bridge plug; a straddle; an expandable plug; a disappearing plug; a rupture disc; and/or an inflatable plug packer.

Either or both of the first and second barriers may be provided using a combination of a means for securing the position of a seal and a separate sealing means. The means for securing the position of the seal and the sealing means need not be located at the same position in the casing, liner and/or liner hanger. Suitable sealing means include, but are not limited to, the following: a ball valve; a flapper valve; a sliding sleeve; a pressure cycle plug; a wireline retrievable plug; a rupture disc; a formation isolation device; a shear disc; and/or a pump open device.

A hydrostatic column of fluid in the well bore may be considered sufficient to serve as one of the barriers provided that the level of the column of fluid can be monitored and topped up if required. This option may be used to complete a well in accordance with preferred aspects of the present invention. However, whilst a hydrostatic column of fluid would not need to be removed in order to facilitate the installation of the completion string in the well-bore, reliance on such a barrier is typically not acceptable, particularly for well suspension, unless it is used for a formation having sub-normal formation pressure.

Having provided the well 10 with two independently verified deep-set barriers 26 and 30, the BOP stack 40 may be removed and retrieved to the rig. The well, as illustrated in FIG. 4, may now be considered suspended. The well may be completed at this time or left in this condition for completion after a period of time.

An advantage of being able to suspend the well in this condition, i.e. with the first and second deep-set barriers in position, is that it becomes possible for the first time to install the completion string in the well without the need to provide a BOP stack to provide one or both of the barriers.

Another advantage of being able to suspend the well in this condition with at least two deep-set barriers is that it is possible to drill and suspend a plurality of wells at a given site above a formation using the type of drilling rigs that accommodate the BOP stack 40 and other pipework for the casing, liner, and completion strings. When the plurality of wells have been suspended as illustrated in FIG. 4, the BOP stack 40 is no longer required and the drilling rig may be moved to another location. Moreover, when drilling and suspending a plurality of wells using the methods of the present invention, the BOP stack 40 may be moved laterally (under water) from one well to the next and need not necessarily be retrieved back to the rig between wells. The potential then exists for the completion of the suspended wells to be done using a smaller type of vessel than normally required for the installation of the tubing hanger and vertical tree.

Another advantage of being able to suspend the well in the manner illustrated in FIG. 4 is that it is possible to carry out the casing hanger space-out measurements by ROV whilst the well is suspended when necessary.

The sequence of steps used to complete the well ready for production depends in part on the type of production flow control device or christmas tree that has been chosen to control the flow from the well during production. It is to be understood that the methods of the present invention are not limited to the particular type of device used to control the flow of fluids to and/or from the well. Christmas trees are broadly categorised into two types; namely, horizontal christmas trees and vertical christmas trees.

A method of completing and/or working over a sub-sea well using a horizontal christmas tree as the production flow control device is described below. A typical prior art method of well completion using horizontal christmas trees relies on the following sequence of steps: a) a BOP stack is used to provide well control while the well is drilled and cased and an (optional) liner installed; b) a first barrier is put in place in the general area above the formation or reservoir; c) the integrity of the first barrier is verified; d) thereafter, a second barrier is positioned towards the uppermost end of the well-bore or in the well-head; e) the integrity of the second barrier is verified; f) thereafter, the BOP stack is removed from the well-head to facilitate installation of the horizontal christmas tree on the well-head; g) the BOP stack is re-run and positioned on the horizontal christmas tree to provide well control when the second (upper) barrier is removed to facilitate passage of the completion string into the well bore; h) a tubing hanger running tool is used in combination with a sub-sea test tree (SSTT) to run the completion string suspended from a tubing hanger through the internal bore of the sub-sea BOP stack and its associated marine riser; i) the tubing hanger is oriented, landed and locked inside the body of the horizontal christmas tree sub-sea; j) the lower barrier is removed; k) a new first barrier is provided in the tubing hanger and verified; l) a new second barrier is positioned above the first, typically in an internal tree cap and verified; and, m) when the integrity of the new first and second barriers has been verified, the sub-sea BOP stack may be retrieved and the well is ready for production.

An embodiment of the method of well completion of this aspect of the present invention for wells using a horizontal christmas tree as the production flow control device is illustrated with reference to the suspended well FIGS. 3 and 4 as well as FIGS. 6 to 10. A sub-sea well 10 is drilled and suspended as described above with reference to FIGS. 3 and 4.

Figure 6:
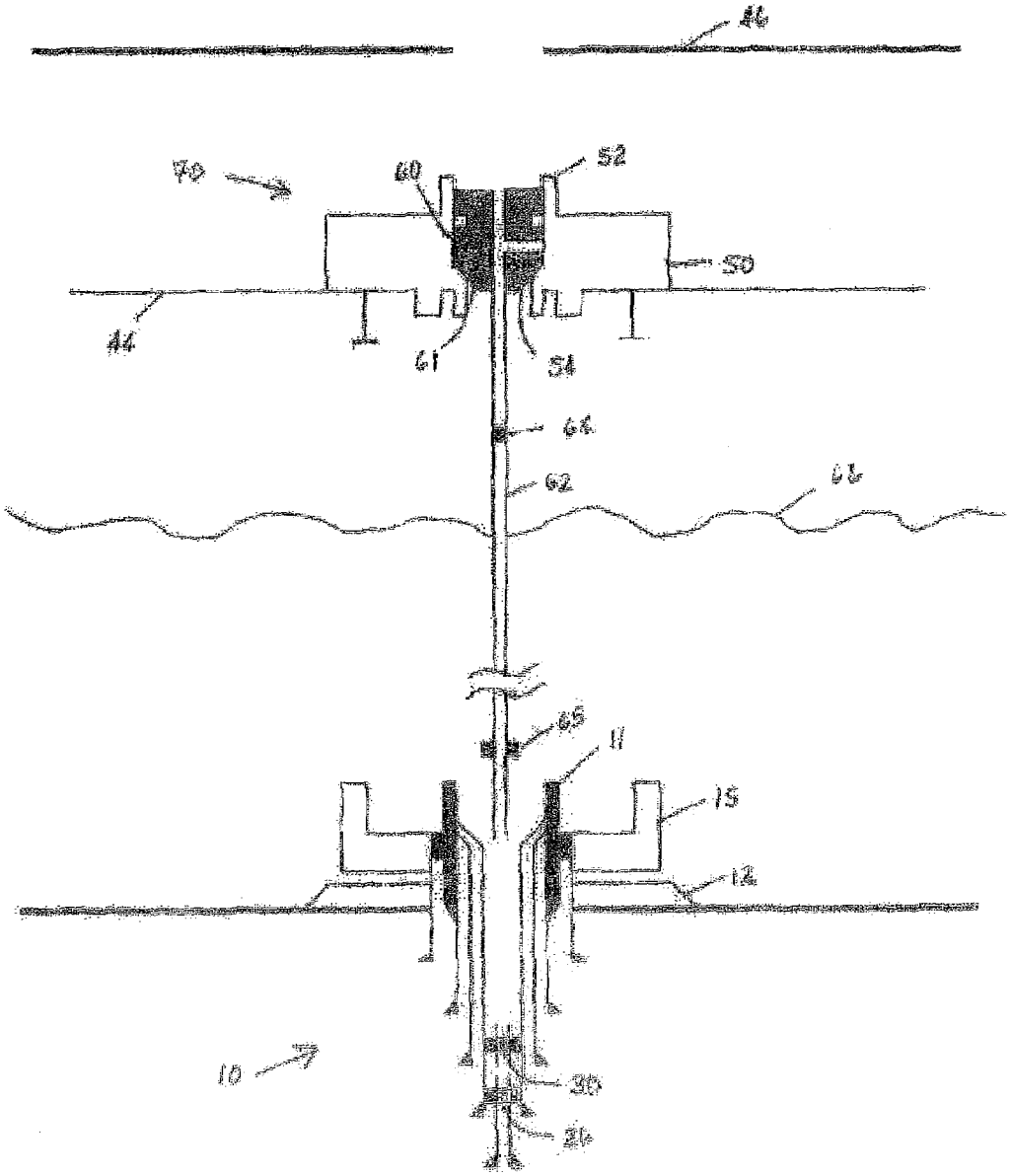
FIG. 6 illustrates a next step in a well completion sequence in accordance with the present invention showing the partial formation of the HXT/TH assembly after suspending the well in accordance with FIG. 4.

With reference to FIG. 6, a horizontal christmas tree 50 is positioned on the cellar deck 44 beneath the rig floor 46. A tubing hanger 60 has been installed within the body of the horizontal christmas tree 50. A completion string 62 is hung from the tubing hanger 60 and is provided with a downhole safety valve 64. The horizontal christmas tree 50 has a body 52 including a shoulder 54 against a correspondingly shaped shoulder 61 of the tubing hanger 60 rests when the tubing hanger 60 has been landed in the body 52 of the horizontal christmas tree 50. The horizontal christmas tree 50 may also be provided with a helix (not shown) to orientate the tubing hanger 60 within the horizontal christmas tree 50.

The installation of the tubing hanger 60 in the horizontal christmas tree is conducted above the water line 66 and, more specifically, on the cellar deck 44 below the rig floor 46 to form a combined horizontal christmas tree/tubing hanger assembly (hereinafter referred to as the HXT/TH assembly) 70 that can be lowered into position in the well after the installation has been verified. To verify the integrity of the HXT/TH assembly 70, all electrical and hydraulic connections are checked. The HXT/TH assembly 70 may also be subjected to pressure testing.

The ability to perform the installation of the tubing hanger in the body of the horizontal christmas tree above the water-line and preferably on the cellar deck of a rig or vessel provides significant advantage over having to perform the installation and verify the connections sub-sea.

Figure 7:
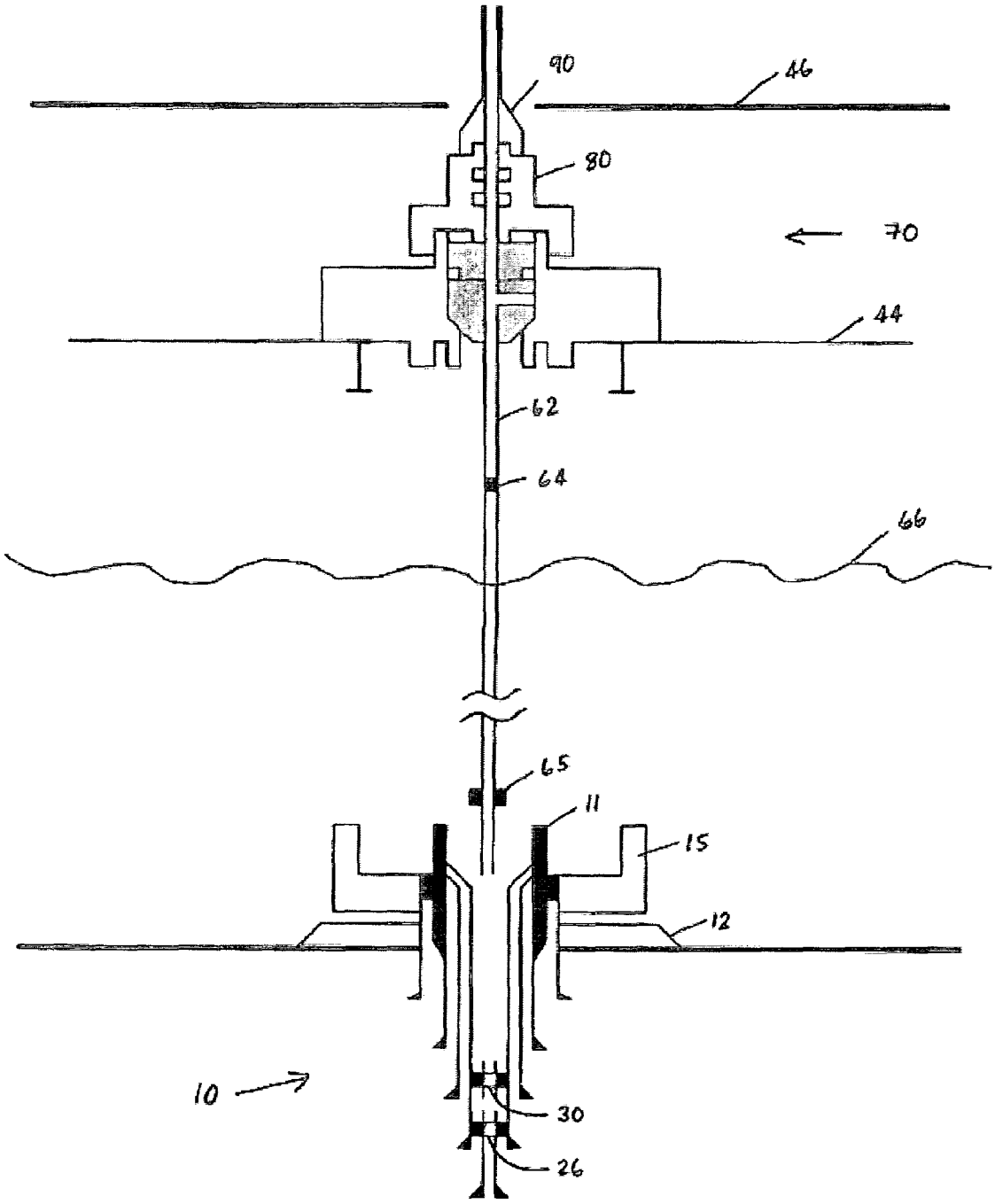
FIG. 7 illustrates a next step in a well completion sequence in accordance with the present invention showing use of a LRP for running the HXT/TH assembly to the wellhead.

With reference to FIG. 7, a lower riser package (LRP) 80 is positioned above the HXT/TH assembly 70 whilst the HXT/TH assembly 70 is on the cellar deck 44. The LRP 80 is provided with rams and/or valves in its vertical bore as a means of providing a barrier. The LRP 80 has an emergency disconnect/connector (EDC) 90 attached to it to enable disconnection from the LRP 80 if necessary, for example, under rough conditions.

Figure 8:
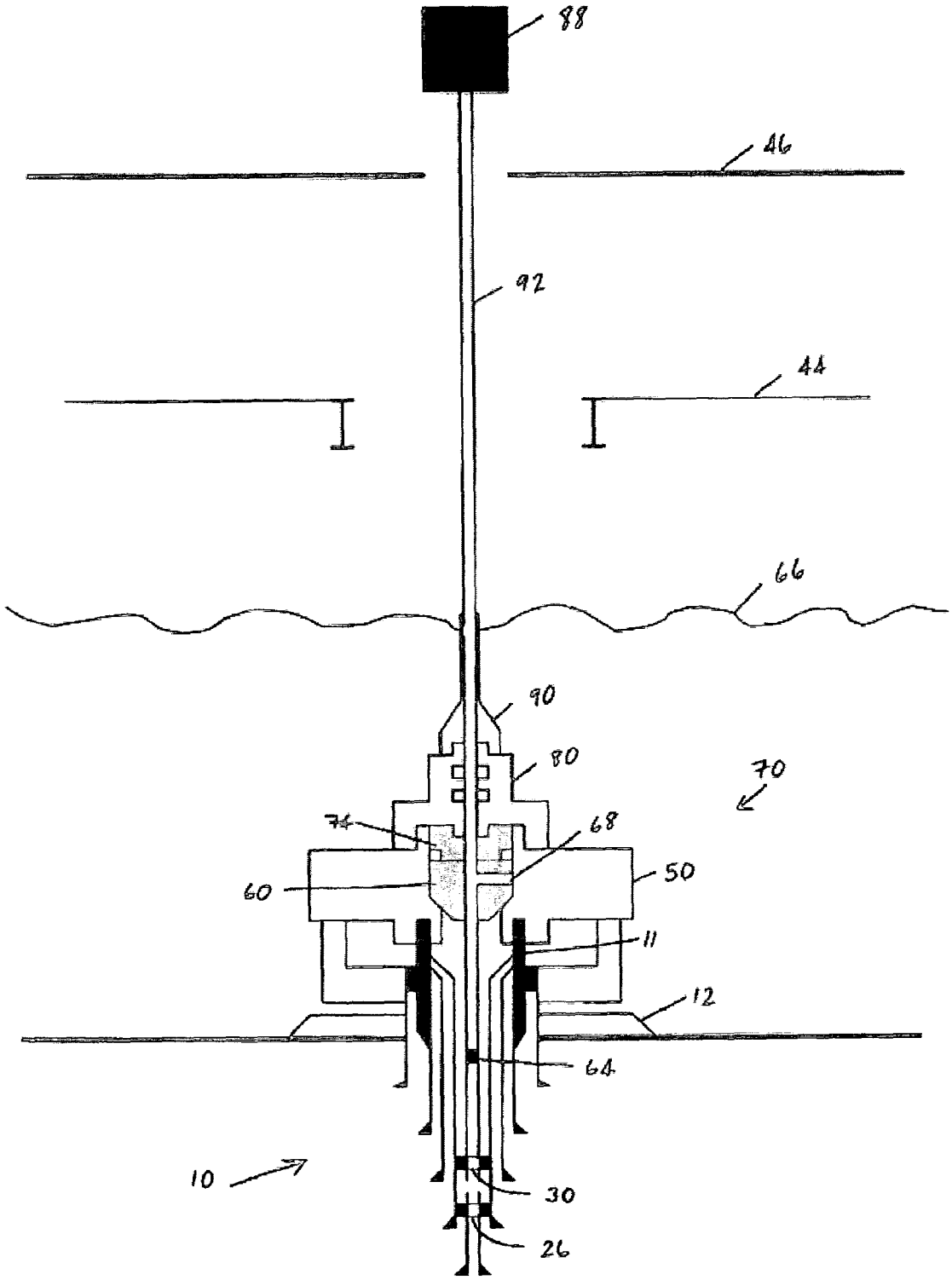
FIG. 8 illustrates a next step in a well completion sequence in accordance with the present invention showing the HXT/TH assembly in position at the wellhead.

With reference to FIG. 8, once the LRP 80 has been installed, the HXT/TH assembly 70 and LRP 80 are run to the well-head in a single operation. During the running of the HXT/TH assembly 70 to the well-head 11, well control is provided by the first and second barriers 26 and 30, respectively, which remain in position.

A tie-back riser, in this example, a monobore completion riser 92 is positioned above the LRP, terminating in a surface flow tree 88. The completion riser is supported and tensioned in the usual manner to accommodate movement of the rig due to sea conditions. The surface flow tree assembly 88 in conjunction with the LRP 80 enables adequate pressure control to be maintained to facilitate wire-line operations and/or well clean-up if desired.

With reference to FIG. 8, once the HXT/TH assembly 70 has been installed on the well-head 11 integrity is verified by testing. Reliance is then placed on the rams/valves of the LRP 80 and/or the valves of the surface tree assembly 88 and/or the valves in the christmas tree to satisfy the statutory requirement for two independent barriers during the removal, typically by wireline, of the first and second barriers, 26 and 30 respectively. The first and second barriers 26 and 30, respectively are removed at this stage to prepare the well for production.

Figure 9:
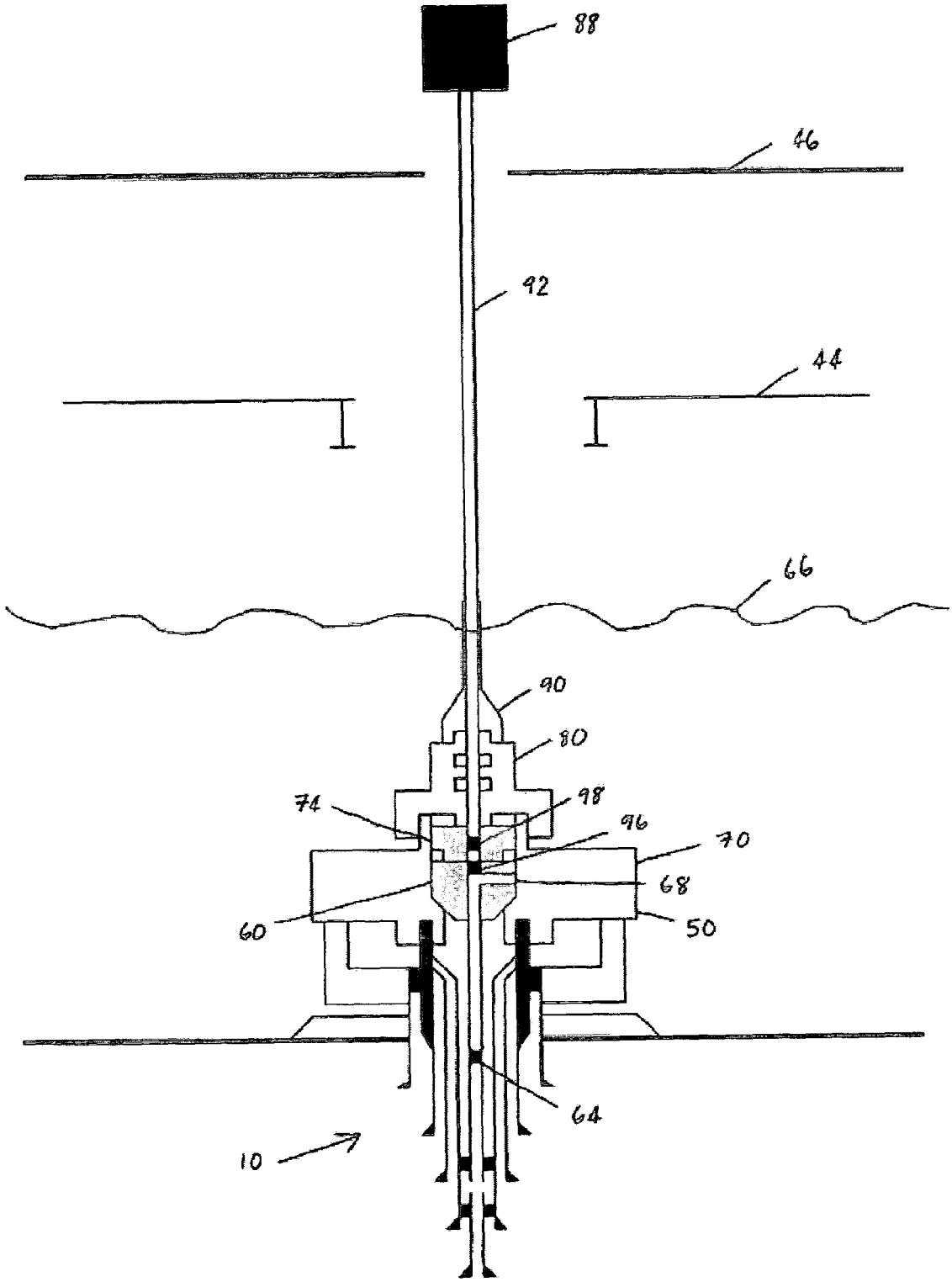
FIG. 9 illustrates a still further step in a well completion sequence in accordance with the present invention showing installation of dual barriers in the tubing hanger and/or tree cap or combined hanger/cap assembly.

With reference to FIG. 9, after the removal of the second and first barriers, 30 and 26, respectively, two new independent barriers must be installed above the level of the fluid outlet port 68 of the HXT/TH assembly 70. A tubing hanger plug 96 and an upper tubing hanger or tree cap plug 98 are run down the monobore completion riser 92 and installed in the tubing hanger 60 and/or tree cap 74 respectively to provide these new barriers. Once the integrity of the tubing hanger plug 96 and tree cap plug 98 have been verified, the LRP 80 and its associated monobore completion riser 92 are removed from the HXT/TH assembly 70.

Figure 10:
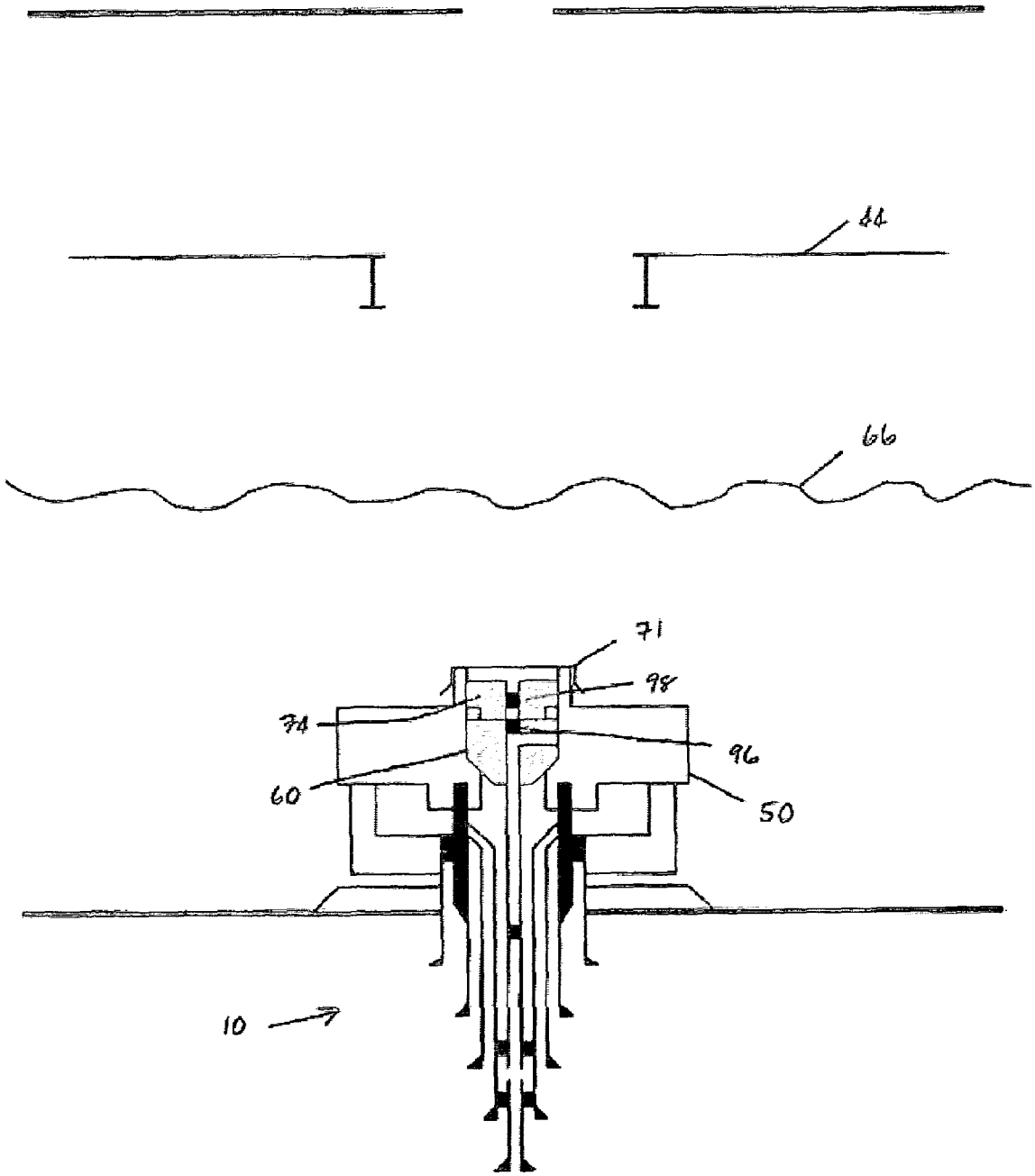
FIG. 10 illustrates a final step in a well completion sequence in accordance with the present invention showing a completed well with dual barriers in the tubing hanger and tubing hanger cap.

With reference to FIG. 10, the final step in the illustrated sequence of well completion operations is the placement of a debris cap 71, typically using a ROV. The well is then ready for production.

When it is required to perform a work-over operation on a well using a horizontal christmas tree for production flow control, similar steps as outlined above are performed in a different order. The work-over may be performed to recover a failed christmas tree or a failed tubing hanger or both. The use of deep-set barriers enables the work-over operation to be conducted without the need to run a BOP stack to the well.

An example of a method of working over a sub-sea well using a horizontal christmas tree for the production flow control device according to one aspect of the present invention is described below with reference to FIGS. 6 to 10 with like reference numerals referring to like parts. As described above in relation to a well completion using a horizontal christmas tree for production flow control, it is to be understood that the particular sequence of steps will vary depending on the objective of a particular work-over operation. The description to follow relates to the removal of the HXT/TH assembly 70. As a first step, the debris cap 71 is removed, typically using an ROV. An LRP 80 and EDC 90 are prepared on the cellar deck 44. This LRP/EDC assembly is then run on a completion riser 92 to above the horizontal christmas tree. The surface tree 88 is made up in the usual manner and the LRP 80 is installed on top of the horizontal christmas tree 50.

The integrity of the connections between the LRP 80 and the horizontal christmas tree 50 is verified, typically by way of pressure and other function tests. Once the LRP 80 is in position, the rams and/or valves in the vertical bore of the LRP 80 satisfy the statutory requirement for two independently verified barriers, enabling removal of the tree cap and tubing hanger plugs, 98 and 96, respectively. Typically, these plugs are recovered by wireline.

The next step is to reinstate the first deep-set barrier 26, in this example, in the first liner hanger 24. The integrity of the first barrier 26 is verified. The second deep-set barrier 30 is then installed, in this example, in the second liner hanger 28 and its integrity is verified in the usual manner.

Once the integrity of the first and second barriers, 26 and 30, respectively, has been verified, the HXT/TH assembly 70 can be unlocked from the well-head 11 and retrieved above the water-line 66. The first and second barriers 26 and 30, respectively, are relied on to satisfy the statutory requirement for two independently verified barriers to be in place during a work-over operation.

The required remedial, maintenance or other repair work is conducted on the horizontal christmas tree and/or tubing hanger, typically on the rig floor 46 or the cellar deck 44. Once the repair has been effected, the HXT/TH assembly 70 is reformed above the water-line 66 and returned to the well 10 using a procedure such as described above in relation to performing a well completion for a well using a horizontal christmas tree for production flow control.

It is to be understood that a work-over operation may also be performed in accordance with this aspect of the present invention without removal of the horizontal christmas tree if desired. In this scenario, the LRP 80 and its associated tie-back riser 92 are run to the well as described above, enabling removal of the tree cap 72 and tubing hanger plugs, 98 and 96, respectively. The first and second deep-set barriers 26 and 30 are installed and verified as described above. The LRP 80 is then retrieved back to the deck 44.

In order to remove only the tubing hanger 60 (along with the completion string 62 suspended from the tubing hanger 60), a tubing hanger running tool (not illustrated) is run to the well to unlock from the body of the christmas tree and retrieve the tubing hanger 60 and completion string 62 leaving the horizontal christmas tree 50 installed at the well-head 11.

For wells using a vertical christmas tree for production flow control, preferred methods of completing and/or working over such a well are now described in detail below with reference to FIGS. 11 to 20 with like reference numerals referring to like parts. The well is first drilled, cased and suspended as described above with reference to FIGS. 3 and 4.

Figure 11:
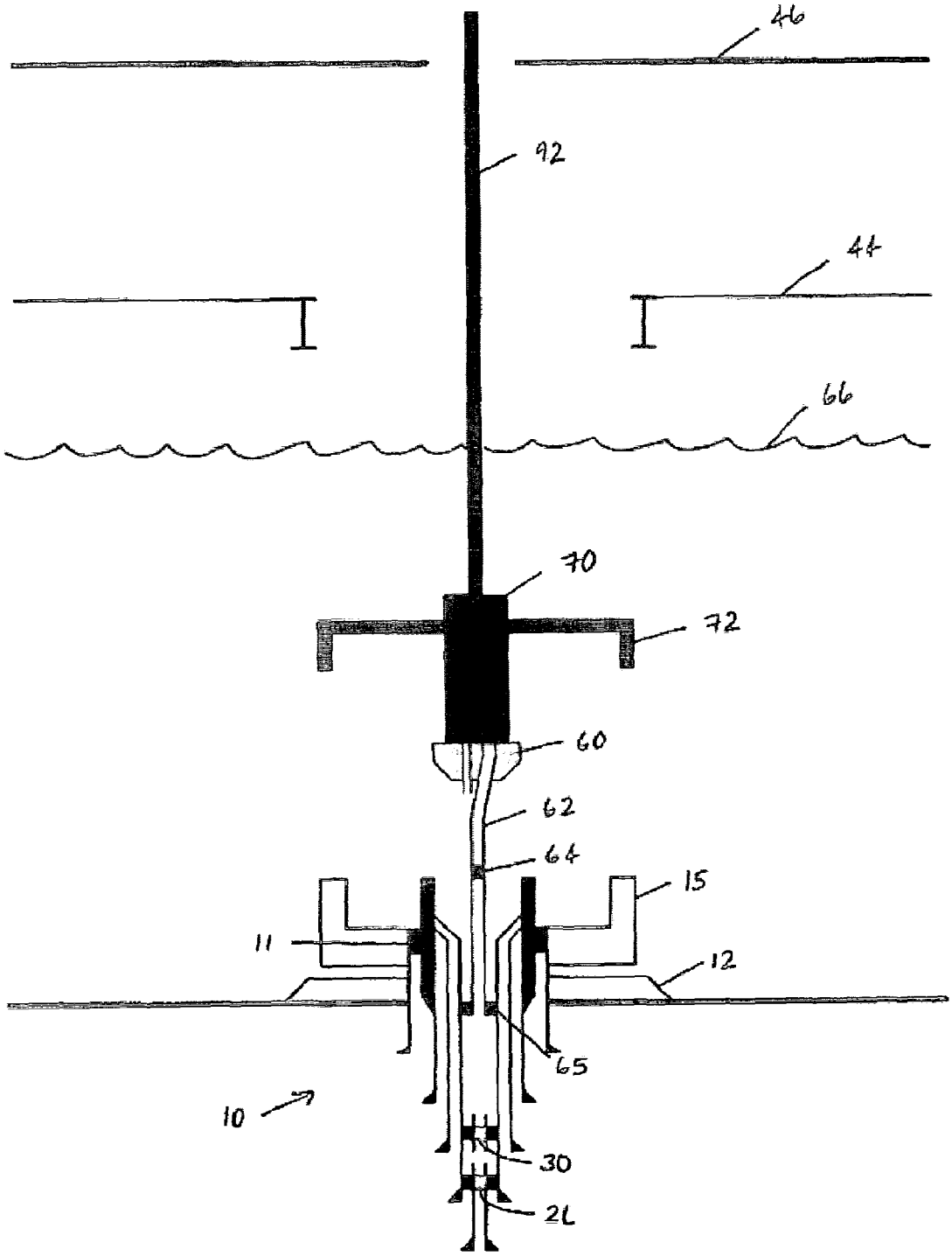
FIG. 11 illustrates a step in a well completion sequence of a first embodiment of the present invention for a well using a vertical christmas tree for production flow control, showing use of a THRT and orientation mechanism for orienting, landing and locking the tubing hanger in the well-head.

With reference to FIG. 11, a completion string 62 is made up on the rig floor 46 terminating at its uppermost end in a tubing hanger 60. A tubing hanger running tool (THRT) 70 is positioned above the tubing hanger 60 and used to assist in orienting, landing, and locking the tubing hanger in the well-head 11. The THRT 70 can also used to set the seals between the tubing hanger 60 and the well-head 11. The THRT 70 is provided with a tubing hanger orientation mechanism 72, which is configured to interface with the orientation devices positioned on the guide base 12. The orientation mechanism 72 may not be required when using a concentric tree.

The tubing hanger 60 with the completion string 62 suspended therefrom is run to the well through open water along with the THRT 70 and tubing hanger orientation mechanism 72. A completion riser or landing string 92 extends above the THRT 70 to the rig floor 46. During the running of the completion string 62, THRT 70 and tubing hanger orientation mechanism 72 to the well, primary well control is provided by at least two independently verified barriers 26 and 30. These barriers are maintained in position at least until the completion string 62 is installed in the well-head 11.

Having verified the orientation of the tubing hanger 60 relative to the well-head 11, if required, using the THRT 70 and its orientation mechanism 72, the tubing hanger 60 is landed in the well-head 11 and locked in position. The installation of the tubing hanger 60 in the well is verified by verifying the integrity of all hydraulic and electrical connections between the tubing hanger 60 and the well-head 11 and/or any downhole equipment.

Figure 12:
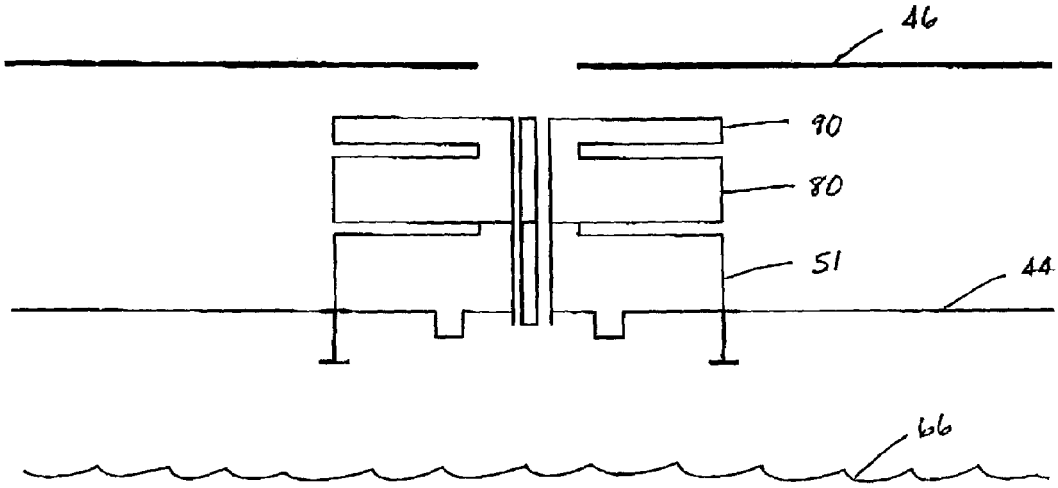
FIG. 12 illustrates a next step in a well completion sequence a first embodiment of the present invention showing the vertical christmas tree with a LRP and EDP being prepared on the cellar deck.
Figure 12:
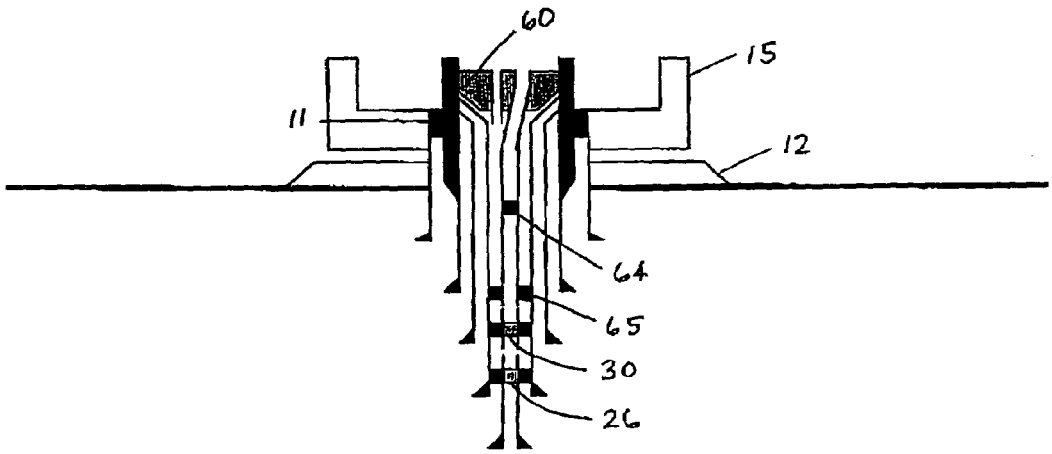

The THRT 70 and its associated orientation mechanism 72 and completion riser 92 are then retrieved to the rig floor. With reference to FIG. 12, a vertical christmas tree 51 with an equivalent number of flow bores as the tubing hanger 60 is positioned on the cellar deck 44. If required, the vertical christmas tree 51 is provided with orientation means to assist in correctly orienting the vertical christmas tree 51 relative to the tubing hanger 60 once installed.

With reference to FIG. 12, a lower riser package (LRP) 80 is positioned above the vertical christmas tree 51 on the cellar deck 44. The LRP 80 is provided with rams and/or valves in the vertical bore as a means of providing barriers. The LRP 80 is a significantly smaller unit than the BOP stack 40 and can thus be run from a smaller vessel than that required to accommodate and run the BOP stack 40. The LRP 80 is used in conjunction with an emergency disconnect connector (EDC) 90 to enable the completion riser 92 to be disconnected from the LRP 80 if necessary; for example, under rough conditions.

Figure 13:
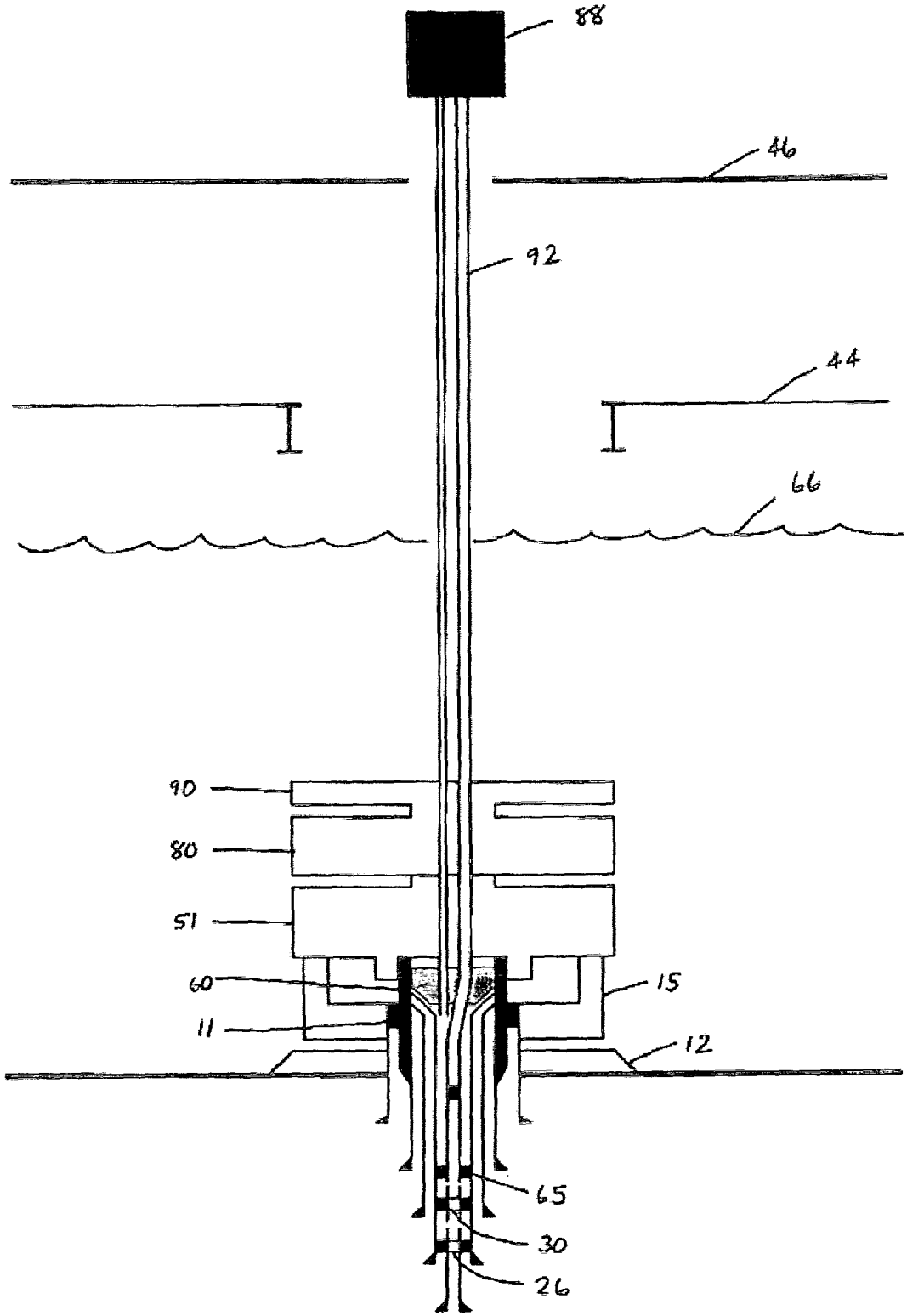
FIG. 13 illustrates a still further step in a well completion sequence of a first embodiment of the present invention showing the well after the vertical christmas tree, LRP and EDP have been installed above the tubing hanger.

With reference to FIG. 13, the LRP 80, EDC 90 and vertical christmas tree 51 are run to the well and positioned on the well-head 11. A tie-back riser, in this example a dual-bore completion riser 92 extends above the EDC 90 back to the rig floor 46. The completion riser 92 is supported and tensioned in the usual manner known in the art to accommodate movement of the rig due to sea state. A surface flow tree assembly 88 is used in connection with the LRP 80 and/or the christmas tree 51 to provide pressure control during well clean-up, if desired, as well as to facilitate any logging and/or perforating operations.

Figure 14:
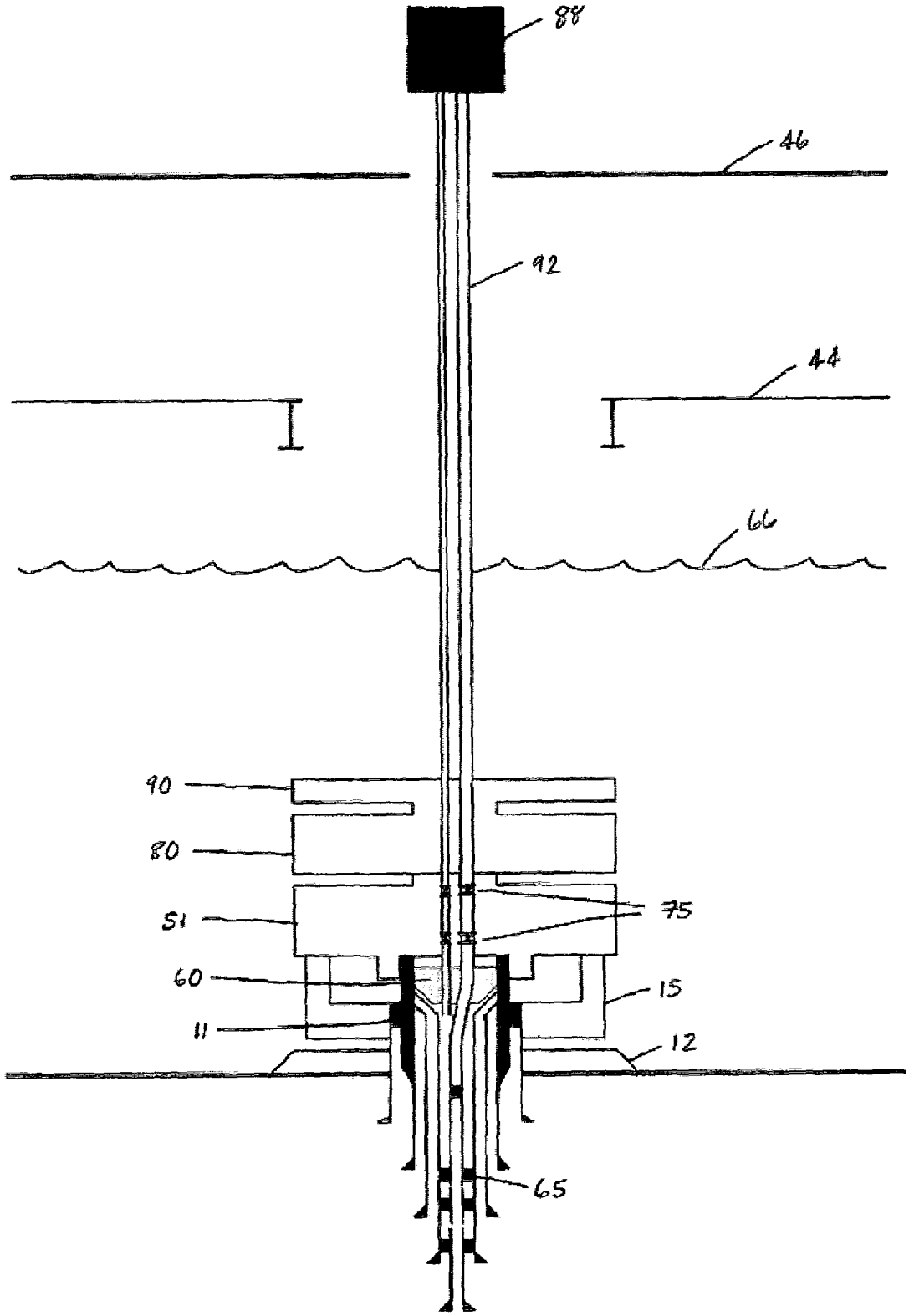
FIG. 14 illustrates a next step in a well completion sequence of a first embodiment of the present invention showing the well when the deep-set barriers have been removed with reliance placed on the flow control valves of the vertical christmas tree and/or LRP assembly to satisfy the statutory requirement for at least two verifiable barriers.

With reference to FIG. 14, once the vertical christmas tree 51 is oriented, landed and locked on the well-head 11, the electrical and hydraulic connections between the tubing hanger 60 and/or well-head 11 and the vertical christmas tree 51 are verified. Each of the flow bores of the vertical christmas tree 70 is provided with at least two valves, plugs and/or caps 75 which are used to control the flow from the well during production.

Reliance is then be placed on the rams of the lower riser package 80, the valves of the surface tree assembly 88 and/or the valves of the christmas tree 51 to satisfy the statutory requirement for two independent verifiable barriers. At this point, the second and first barriers, 30 and 26 respectively, are removed, typically by wire line or any other suitable retrieval means, depending on the type of barrier used. The LRP 80 and EDC 90, as well as the associated completion riser 92 are retrieved to the rig floor 46.

Figure 15:
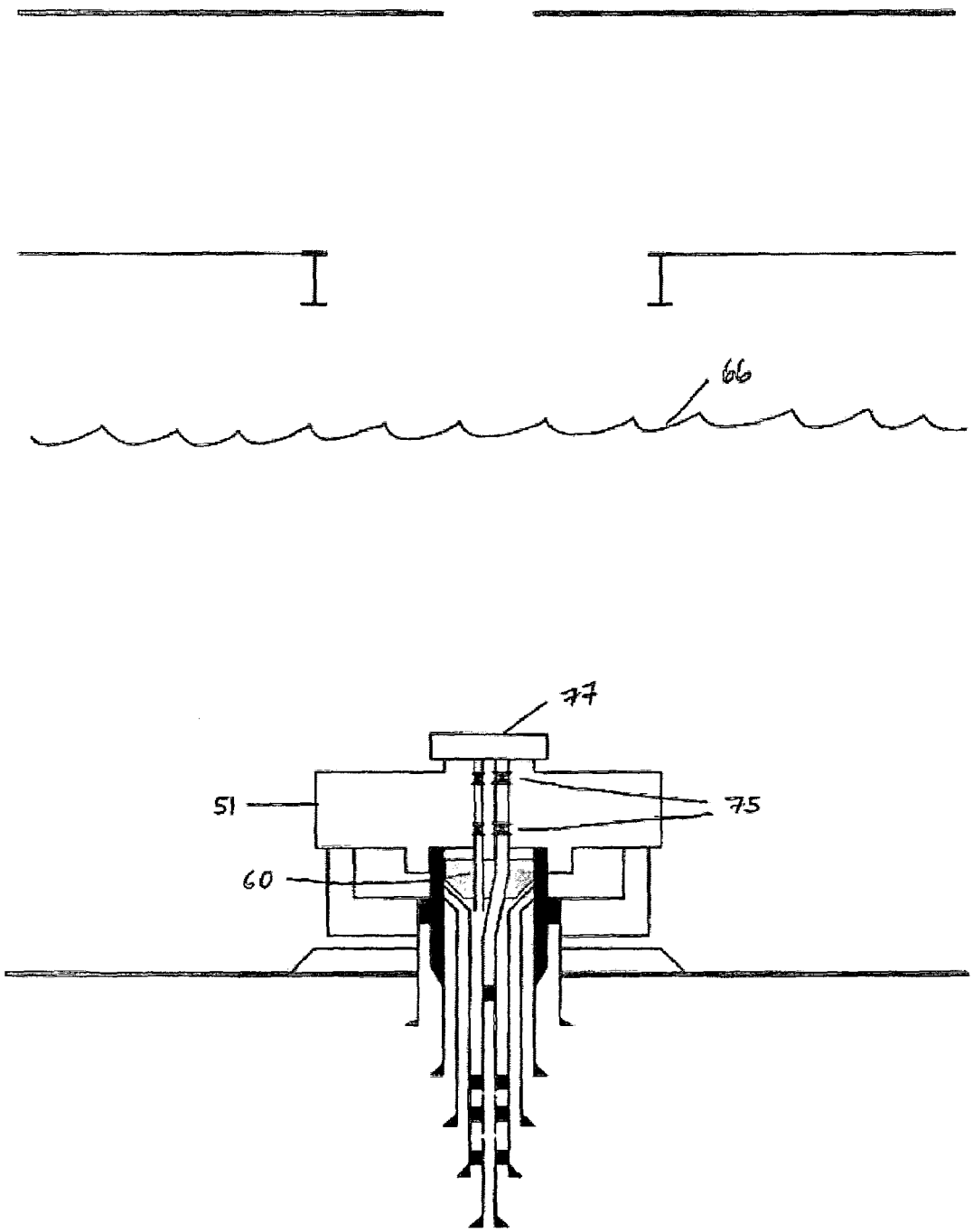
FIG. 15 illustrates the completed well of the first embodiment of the present invention with a tree cap in place.

With reference to FIG. 15, a tree cap 77 is then placed on the vertical christmas tree 51 and the well has been completed.

A method of completing a sub-sea well incorporating a tubing spool is illustrated in FIGS. 16 to 20. Tubing spools are used where downhole requirements necessitate a large number of flow and communication paths from the well bore to the vertical christmas tree 51. When a tubing spool is used, some of the communication paths may be routed through the tubing spool instead of through the tubing hanger. It is possible to run the tubing head spool from an alternative vessel than the type of drilling vessel required to accommodate and run a BOP stack. In this embodiment, it is possible to run the tubing head spool from an alternative vessel than the type of drilling vessel required to accommodate and run a BOP stack.

Figure 16:
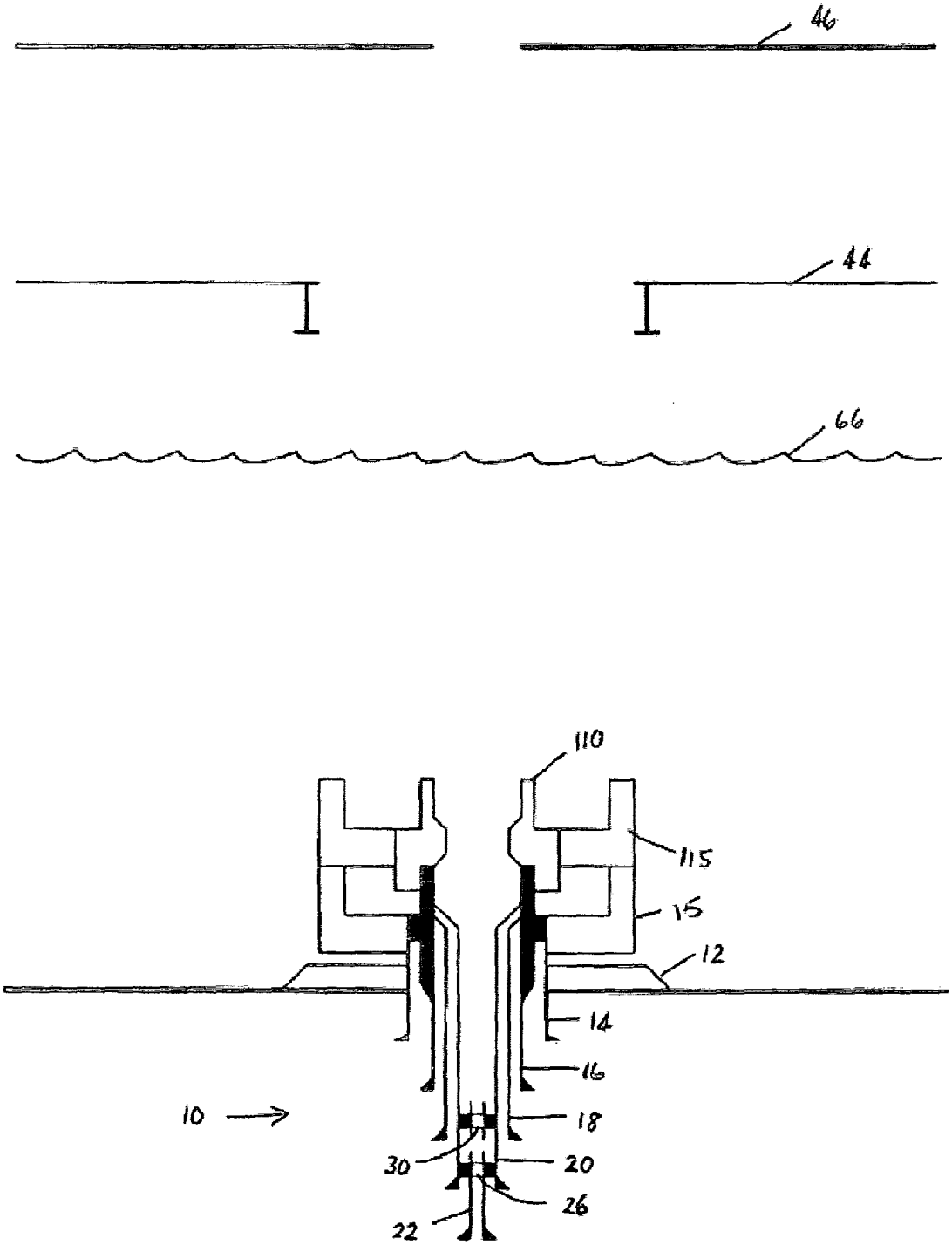
FIG. 16 illustrates a step in a well completion sequence according to a second preferred embodiment of the present invention showing the placement of a tubing spool in the well-head after suspending the well in accordance with FIG. 4.

The first and second independently verifiable barriers 26 and 30, respectively, are positioned in the same way as described in the first embodiment with reference to FIGS. 3 and 4. With reference to FIG. 16, a tubing spool guide base 115 is installed above the guide base 15. A tubing spool 110 is then installed on the well-head 11 of the suspended well of FIG. 4. The tubing spool guide base 115 may be used to assist in orienting the tubing hanger 60 relative to the tubing spool 110. Alternatively, the tubing spool 110 may include an indexing mechanism for this function.

Figure 17:
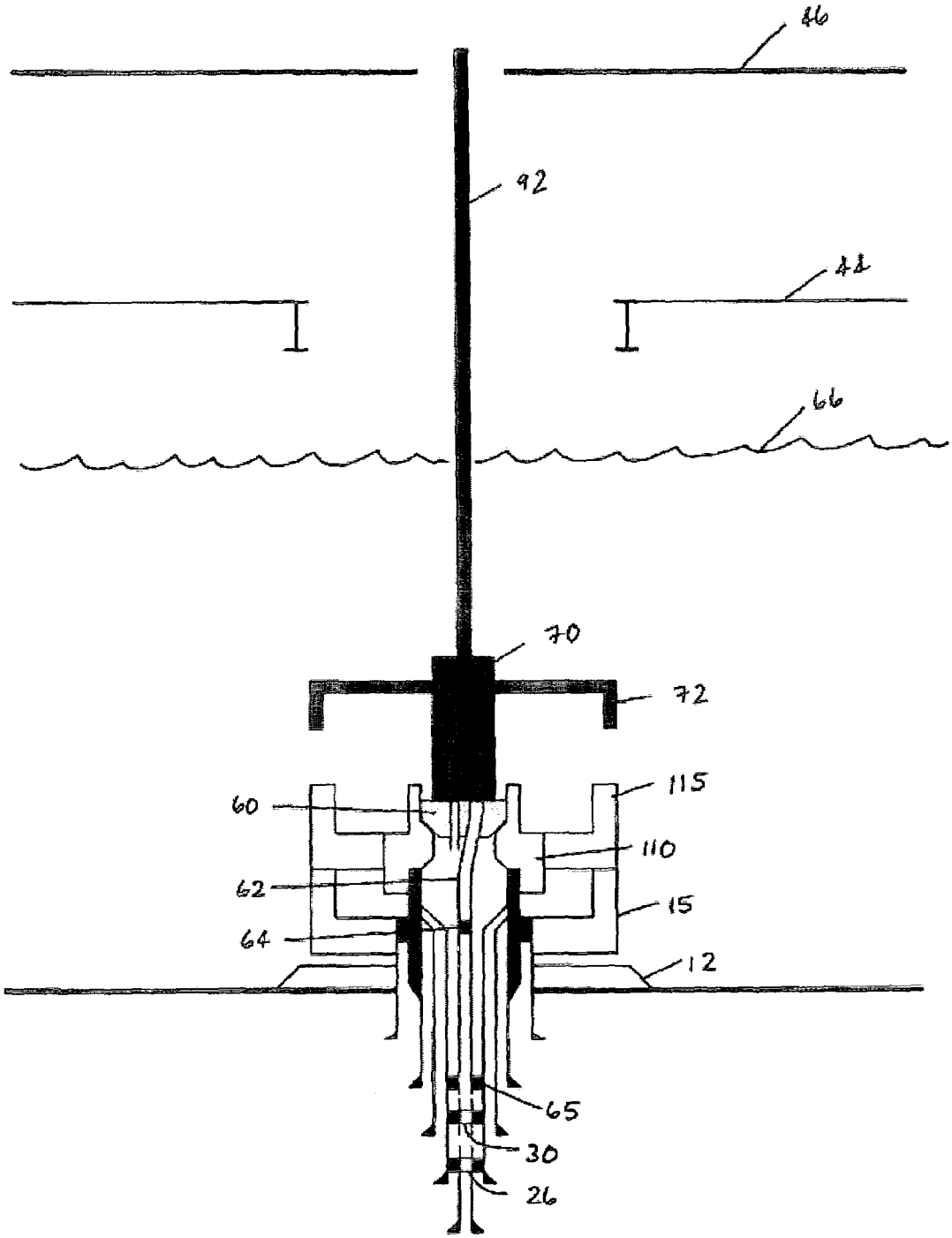
FIG. 17 illustrates a next step in a well completion sequence of a second embodiment of the present invention in showing the use of a THRT and orientation mechanism for orienting, landing and locking the tubing hanger in the tubing spool.

With reference to FIG. 17, a completion string 62 is made up, terminating at its upper end in a tubing hanger 60 in the manner described above. A THRT 70 with an associated orientation mechanism 72 is used to orient the tubing hanger 60 relative to the tubing spool 110. As an alternative, the orientation mechanism 72 may be provided on the tubing head spool 110 instead of the THRT 70 if preferred. On completion of correct orientation, the tubing hanger 60 is landed in the tubing spool 110 and locked in position. The integrity of the interfaces between the tubing hanger 60 and the tubing spool 110 are then verified. The THRT 70 is retrieved to allow for installation of the vertical christmas tree 51.

Figure 18:
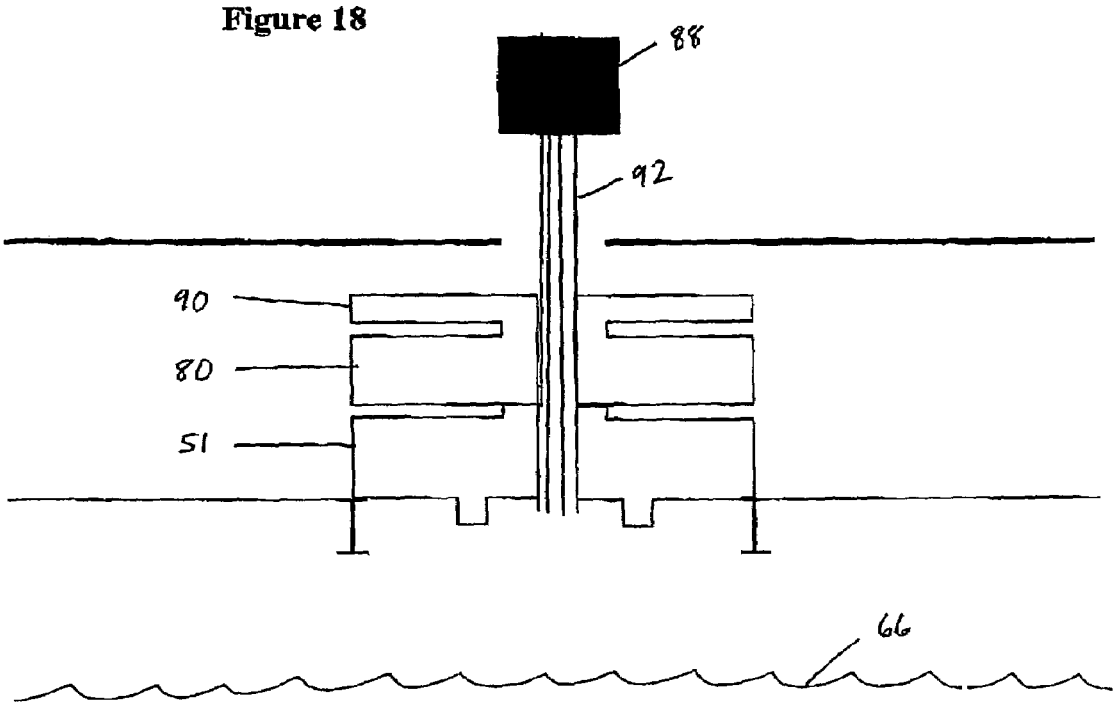
FIG. 18 illustrates a next step in a well completion sequence a second embodiment of the present invention showing the vertical christmas tree with a LRP and EDP being prepared on the cellar deck whilst maintaining the dual deep-set barriers.
Figure 18:
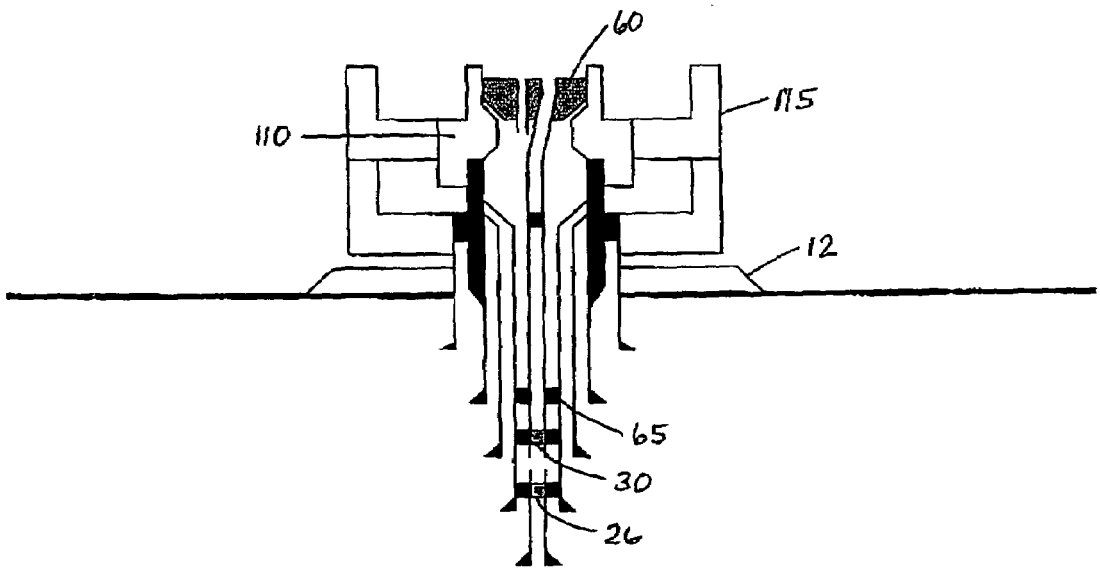

With reference to FIG. 18, a vertical christmas tree 51 with an equivalent number of flow bores as the tubing hanger 60 is positioned on the cellar deck 44. If required, the vertical christmas tree 51 is provided with orientation means to assist in correctly orienting the vertical christmas tree 51 relative to the tubing hanger 60 once installed. A lower riser package (LRP) 80 is positioned above the vertical christmas tree 51 on the cellar deck 44. The LRP 80 is used in conjunction with an emergency disconnect connector (EDC) 90 to enable the completion riser 92 to be disconnected from the LRP 80 if necessary; for example, under rough conditions.

The LRP 80, EDC 90 and vertical christmas tree 51 are run to the well and positioned above the tubing spool 110. A tie-back riser, in this example a dual-bore completion riser 92 extends above the EDC 90 back to the rig floor 46.

Figure 19:
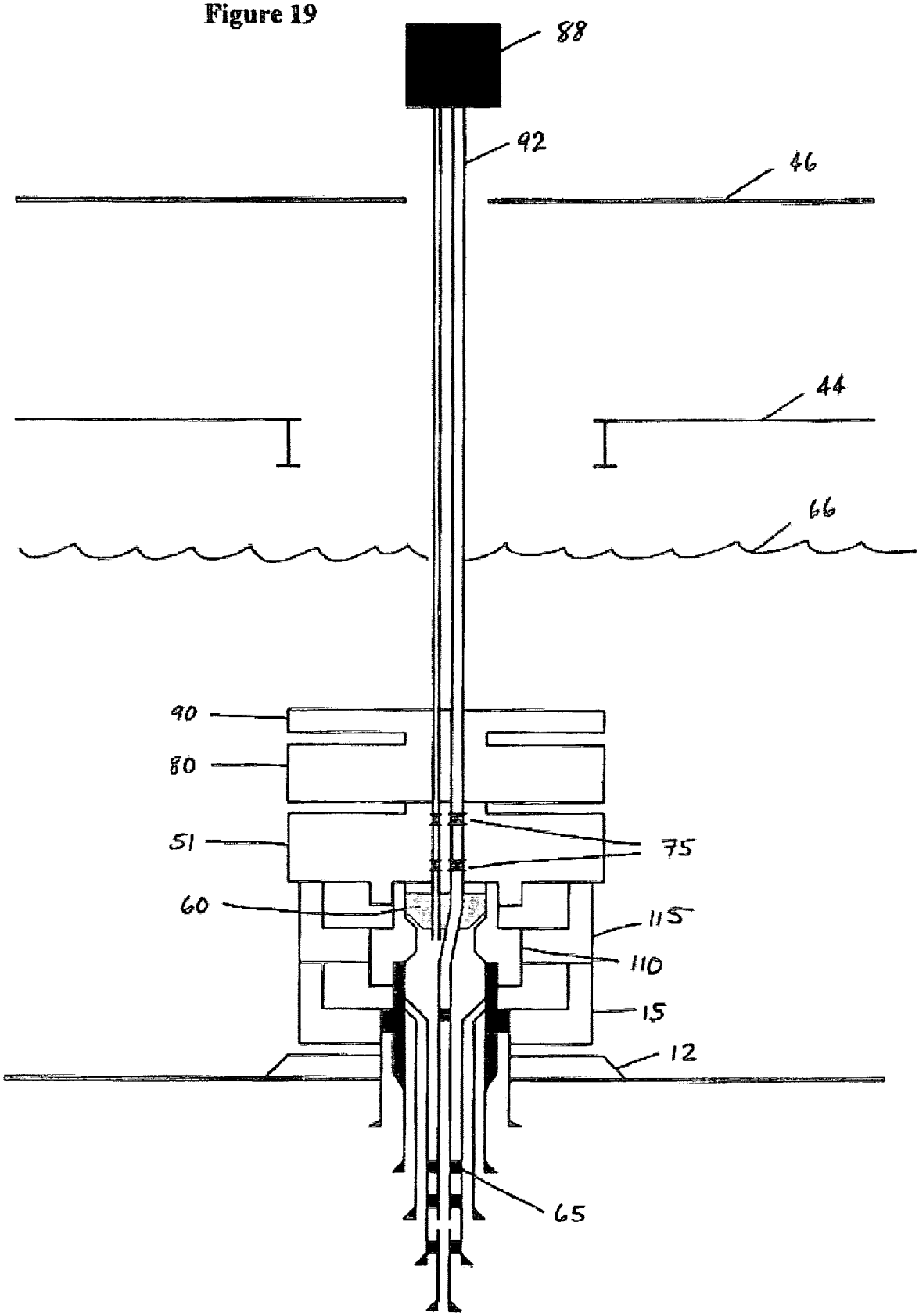
FIG. 19 illustrates a still further step in a well completion sequence of a second embodiment of the present invention showing the well after the vertical christmas tree, LRP and EDP have been installed above the tubing hanger with the deep-set barriers removed and reliance placed on the flow valves in each vertical bore of the vertical christmas tree and/or LRP assembly; and, FIG. 20 illustrates the completed well of the second embodiment of the present invention with a tree cap in place; and, FIGS. 21 to 23 illustrate alternative embodiments of dual barrier systems to that illustrated in FIG. 5.
Figure 20:
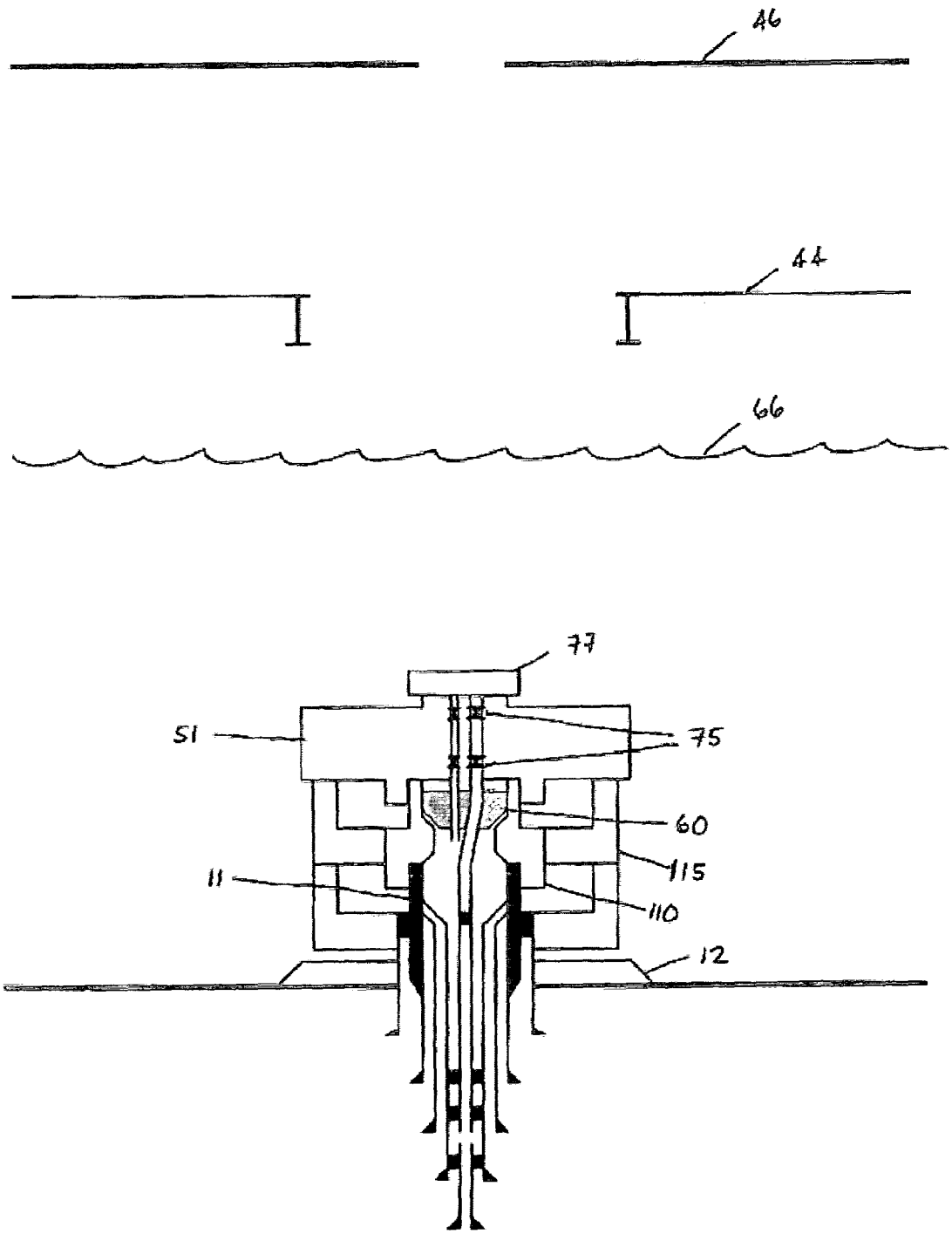

With reference to FIG. 19, having installed the christmas tree above the tubing head spool 110 and tubing hanger 60, the first and second deep-set barriers 26 and 30, respectively are retrieved as described for the first preferred embodiment above. The flow valves 75 of the christmas tree 51 are shut to allow removal of the lower riser package and the well is provided with a tree cap 77 if desired as illustrated in FIG. 20.

When it is required to conduct a workover operation on the sub-sea well using a vertical christmas tree for product flow control, similar steps as those described above are performed in a different order. A workover operation may be performed to recover a failed christmas tree, a failed tubing hanger and/or a failed completion string. As a first step in a workover operation, the first and second barriers 26 and 30 respectively are sequentially reinstated and verified to provide primary well control prior to the removal of the vertical christmas tree 51 and/or tubing hanger 60. Once again, the use of the two deep-set independently verified barriers enables the workover operation to be conducted without the need to run a BOP stack to the well.

A typical sequence for a workover operation for a well using a vertical christmas tree for production flow control is described below with reference to the illustrated embodiment illustrated in FIGS. 11 to 15. It is to be appreciated that if the well includes a tubing spool, the tubing spool typically remains in position on the well-head whilst remedial work is performed on the tubing hanger and/or vertical christmas tree.

For a workover operation requiring removal of the tubing hanger 60, the tree cap 77 is removed, typically using an ROV. A lower riser package (LRP) 80 and emergency disconnect/connector (EDC) 90 are prepared on the cellar deck 44 and run to the well. A surface tree 88 is made up in the usual manner and the lower riser package 80 is installed on the vertical christmas tree 51. The integrity of the connections between the LRP 80 and the vertical christmas tree 51 are verified in the usual manner.

With the LRP 80 in position, the rams and/or valves in the vertical bore of the LRP 80 are able to satisfy the statutory requirement of providing two independently verifiable barriers, enabling the opening of the flow valves 75 in the vertical flow bores of the vertical christmas tree 51.

The next step is to reinstate the first and second barriers 26 and 30 as described above with reference to FIG. 4. Once the integrity of the first barrier 26 has been verified, the second barrier 30 is installed and then verified. The vertical christmas tree 51 may then be unlocked from the tubing hanger 60 and retrieved to the rig where the remedial work is conducted. The tubing hanger 60 may also be unlocked and retrieved to the rig for remedial, maintenance or other repair work if required.

The remedial work is conducted typically on the rig floor 46 or the cellar deck 44. Once the repair has been effected, the tubing hanger 60 is returned and installed into the well-head 11 or tubing spool 110 in the manner described above for well completions. The vertical christmas tree 51 is then also reinstalled onto the well-head 11 using the procedure described above in relation to the methods of performing a well completion.

Now that the preferred embodiments of the present invention have been described in detail, the present invention has a number of advantages over the prior art, including the following:

(a) elimination of the need to run a BOP stack for the second time during well completion operations;

(b) the ability to use a lower riser package in place of a BOP stack during the installation of the production flow control device for sub-sea wells;

(c) the ability to use only a lower riser package as opposed to a BOP stack for workover operations and interventions presents a significant cost saving by eliminating the tradition requirement to use a drilling BOP stack and marine riser for sub-sea wells;

(d) the risk of debris entering the tubing hanger is reduced as it is no longer required for the tubing hanger to be installed through the bore of a BOP stack (and marine riser for sub-sea wells).

For wells using horizontal christmas trees for production flow control the methods of the present invention provide additional advantages including the following:

(e) the ability to perform installation of the tubing hanger in the body of a horizontal christmas tree above the water line, which is a far easier operation than performing this operation sub-sea and simplifies any remedial actions;

(f) the ability to make up and verify all electrical and hydraulic connections and penetrations above the water line;

(g) elimination of the need to use a sub-sea test tree for sub-sea wells using horizontal christmas trees; and, (h) the ability to use a lower riser package (LRP) in place of SSTT for wells using a horizontal christmas tree. The LRP is considerably more robust and reliable and eliminates the need to source and interface with high-cost rental equipment.

Numerous variations and modifications will suggest themselves to persons skilled in the relevant art, in addition to those already described, without departing from the basic inventive concepts. All such variations and modifications are to be considered within the scope of the present invention, the nature of which is to be determined from the foregoing description and the appended claims.

The invention claimed is:

1. A method of completing a sub-sea well using a horizontal christmas tree for production flow control, the horizontal christmas tree having a body, the method comprising the steps of:

forming an assembly by installing a completion string terminating at its upper end in and suspended from a tubing hanger in the body of the horizontal christmas tree, the assembly being formed above the water line; and, running the assembly to the sub-sea well, wherein the tubing hanger and the horizontal christmas tree are above the water-line during the step of forming the assembly while control of the well is maintained by using at least two independently verifiable deep-set well control barriers.

2. A method of completing a sub-sea well using a horizontal christmas tree for production flow control according to claim 1, wherein the step of forming the assembly further comprises the steps of landing and locking the tubing hanger in the body of the christmas tree.

3. A method of completing a sub-sea well using a horizontal christmas tree for production flow control according to claim 2, wherein the method further comprises the step of verifying the integrity of the completed assembly above the water line.

4. A method of completing a sub-sea well using a horizontal christmas tree for production flow control according to claim 3, wherein the step of verifying the integrity comprises the step of verifying hydraulic and electrical interfaces between the tubing hanger and the body of the christmas tree.

5. A method of completing a sub-sea well using a horizontal christmas tree for production flow control according to claim 3, wherein the step of verifying the integrity further comprises the step of verifying the pressure integrity of the assembly.

6. A method of completing a sub-sea well using a horizontal christmas tree for production flow control according to claim 1, wherein the step of running the assembly to the well head comprises the step of using a lower-riser package.

7. A method comprising:

coupling a tubing string with a Christmas tree above water; and landing the Christmas tree on a subsea wellhead while maintaining control of the well using at least two independently verifiable deep-set well control barriers.

8. The method of claim 7, wherein coupling the tubing string with the Christmas tree comprises installing a tubing hanger on an uppermost joint of the tubing string and locking the tubing hanger to the Christmas tree.

9. The method of claim 7, further comprising:

running the Christmas tree, the tubing hanger, and the tubing string open-water to a well extending from the subsea wellhead.

10. The method of claim 9, wherein running the Christmas tree, the tubing hanger, and the tubing string further comprises running the Christmas tree, the tubing hanger, and the tubing string without a blow-out preventer.

11. The method of claim 7, wherein coupling the tubing string with the Christmas tree comprises installing a tubing hanger on an uppermost joint of the tubing string, locking the tubing hanger in a tubing spool, and attaching the tubing spool to the Christmas tree.

12. A method comprising:

coupling a tubing string with a tubing hanger above water;

landing the tubing hanger on a subsea wellhead; and landing a Christmas tree on the subsea wellhead while maintaining control of the well using at least two independently verifiable deep-set well control barriers.

13. The method of claim 12, further comprising:

latching the tubing hanger to the Christmas tree.

14. The method of claim 12, further comprising:

latching the tubing hanger to the wellhead.

15. The method of claim 12, wherein landing the tubing hanger on the subsea wellhead further comprises landing the tubing hanger on the subsea wellhead via a tubing spool and latching the tubing hanger to the tubing spool.

* * * * *